US008752354B2

(12) United States Patent
Honey

(10) Patent No.: US 8,752,354 B2
(45) Date of Patent: Jun. 17, 2014

(54) FRAME ASSEMBLY FOR SHEET MATERIAL

(75) Inventor: Ian Honey, Colchester (GB)

(73) Assignees: Ian Honey, Colchester (GB); John Brades, Hertfordshire (GB); John Zucker, London (GB)

( * ) Notice: Subject to any disclaimer, the term of this patent is extended or adjusted under 35 U.S.C. 154(b) by 0 days.

(21) Appl. No.: 12/390,347

(22) Filed: Feb. 20, 2009

(65) Prior Publication Data

US 2009/0211190 A1 Aug. 27, 2009

Related U.S. Application Data

(63) Continuation of application No. PCT/GB2007/003172, filed on Aug. 21, 2007.

(30) Foreign Application Priority Data

Aug. 21, 2006 (GB) ..... 0616582.3

(51) Int. Cl.

| | |
|---|---|
| ***E04C 2/38*** | (2006.01) |
| ***E06B 5/12*** | (2006.01) |
| ***E06B 3/66*** | (2006.01) |
| ***E06B 3/964*** | (2006.01) |
| ***E06B 3/58*** | (2006.01) |

(52) U.S. Cl.

CPC ..... *E06B 3/5878* (2013.01); *E06B 5/12* (2013.01); *E06B 3/6621* (2013.01); *E06B 3/9641* (2013.01)

USPC ..... 52/656.5; 52/656.6

(58) Field of Classification Search

USPC ..... 52/656.1, 656.2, 656.4, 656.5, 656.6

See application file for complete search history.

(56) References Cited

U.S. PATENT DOCUMENTS

| | | | | |
|---|---|---|---|---|
| 1,703,230 | A * | 2/1929 | Gillar | 52/209 |
| 1,897,476 | A * | 2/1933 | Himmel et al. | 52/204.591 |
| 2,264,187 | A * | 11/1941 | Owen | 52/172 |

(Continued)

FOREIGN PATENT DOCUMENTS

| | | | |
|---|---|---|---|
| DE | 198 57 982 | A1 | 7/2000 |
| EP | 1 016 771 | A2 | 7/2002 |

(Continued)

OTHER PUBLICATIONS

Translation of Foreign Patent Document DE 19857982A1 to Hoffmeister.*

*Primary Examiner* — Brent W Herring

(74) *Attorney, Agent, or Firm* — Blakely Sokoloff Taylor & Zafman

(57) ABSTRACT

A frame assembly for sheet material. A plurality of inner frame sections have at least one recess for receiving the sheet material. The inner frame sections can be fitted around at least part of the periphery of the sheet material. A first outer frame for receiving the sheet material with the inner frame sections fitted thereon is provided, together with a second outer frame to be applied to the sheet material with the inner frame sections fitted thereon. A mechanism to connect the first and second external frames together is provided, with the inner frame sections therebetween. The first and second outer frames together define a space whose shape corresponds to that of the outer cross-sectional shape of the inner frame sections. Thus, the first and second outer frames capture the sheet material with the inner frame sections fitted thereon. A mechanism to hold the inner frame section in place is included.

14 Claims, 22 Drawing Sheets

(56) References Cited

U.S. PATENT DOCUMENTS

| | | | | | |
|---|---|---|---|---|---|
| 2,525,717 | A | * | 10/1950 | Ottenheimer | 52/172 |
| 3,192,575 | A | * | 7/1965 | Rosenau, Jr. et al. | 52/171.1 |
| 3,540,118 | A | | 11/1970 | Hugees | |
| 4,134,238 | A | * | 1/1979 | Auger | 52/127.3 |
| 4,347,835 | A | * | 9/1982 | Seemann | 126/590 |
| 4,364,209 | A | * | 12/1982 | Gebhard | 52/208 |
| 4,376,359 | A | * | 3/1983 | Redman | 52/127.1 |
| 4,380,994 | A | * | 4/1983 | Seemann | 126/633 |
| 4,459,789 | A | * | 7/1984 | Ford | 52/656.5 |
| 4,589,624 | A | * | 5/1986 | Jones | 249/177 |
| 4,612,743 | A | * | 9/1986 | Salzer | 52/208 |
| 5,313,761 | A | * | 5/1994 | Leopold | 52/786.1 |
| 5,392,574 | A | * | 2/1995 | Sayers | 52/217 |
| 5,557,894 | A | * | 9/1996 | Card | 52/204.595 |
| 5,743,632 | A | * | 4/1998 | Carl | 362/294 |
| 5,853,828 | A | * | 12/1998 | Schimmelpenningh et al. | 428/34 |
| 5,907,927 | A | * | 6/1999 | Lieb et al. | 49/375 |
| 5,910,083 | A | * | 6/1999 | Richardson et al. | 52/171.1 |
| 6,289,641 | B1 | * | 9/2001 | McCandless | 52/172 |
| 6,311,439 | B1 | * | 11/2001 | Arcati et al. | 52/204.51 |
| 6,581,342 | B1 | * | 6/2003 | Tavivian | 52/204.595 |
| 6,647,677 | B1 | * | 11/2003 | Berger, Jr. | 52/204.1 |
| 7,104,015 | B2 | * | 9/2006 | Huynh | 52/208 |
| 7,588,653 | B2 | * | 9/2009 | Crandell et al. | 156/109 |
| 7,856,791 | B2 | * | 12/2010 | Rosskamp et al. | 52/786.13 |
| 8,297,007 | B2 | * | 10/2012 | Sayer | 52/171.1 |
| 2007/0261359 | A1 | * | 11/2007 | Buchanan et al. | 52/684 |

FOREIGN PATENT DOCUMENTS

| | | | |
|---|---|---|---|
| GB | 1 586 714 | | 3/1981 |
| GB | 2 121 466 | A | 12/1983 |
| JP | 10-317805 | | 12/1998 |
| JP | 2001-055870 | A | 2/2001 |
| WO | WO 03/074387 | A1 | 9/2003 |

* cited by examiner

*Fig. 19a*
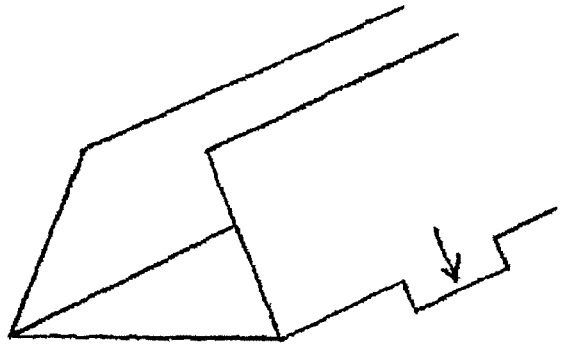
*Fig. 19b*
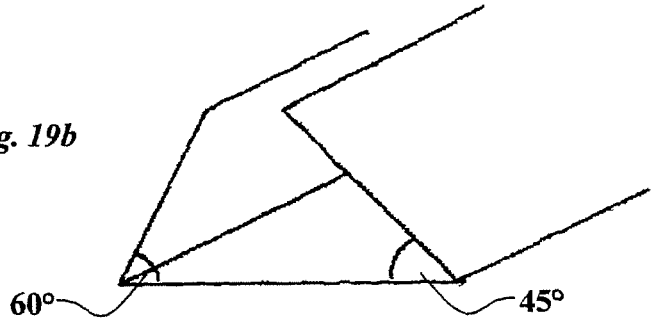
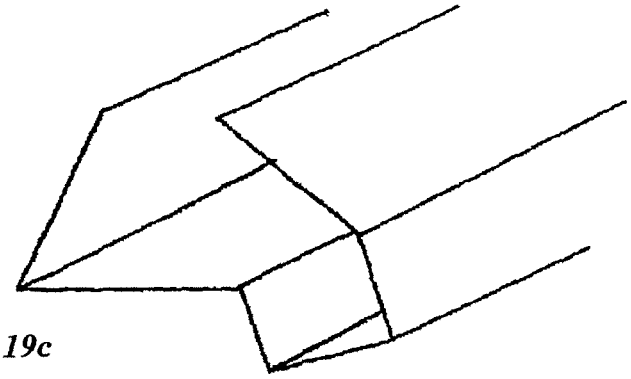
*Fig. 19c*

FRAME ASSEMBLY FOR SHEET MATERIAL

The present patent application is a continuation application of International Application No. PCT/GB2007/003172, filed Aug. 21, 2007.

This invention relates to an assembly for sheet material, especially transparent or translucent panels for use in civil construction.

Panel structures comprising sheet material and using supporting frames are employed in numerous situations, especially in the field of civil construction. For example, panel structures are used in the fabrication of windows, interior/exterior walls including curtain walling and partition walls, and doors. These structures may use any combination of glass and/or solid metal/polymer sheets.

The process of manufacturing such panel structures typically comprises providing material in large sheets and cutting these sheets to a particular size that fits a given size of supporting frame. The sheets may then be fitted into the supporting frame(s) using various methods depending on the structure of the frame(s).

Numerous frames are known that accommodate the reception of single sheets of material. A panel structure comprising a single sheet of material supported by a frame is typically referred to as a 'single panelled' structure. More recently, frames have also been designed to accommodate more than one sheet of material. As a result panel structures comprising two generally parallel sheets of material supported by a frame are now widely known and referred to as 'double panelled' structures. Similarly, 'triple panelled' structures have been demonstrated, although structures comprising three or more generally parallel sheets of material supported by a frame are not widely seen as practical. Where the material supported in the frame is glass, the structure is generally referred to as "single glazed", "double glazed" or "triple glazed" structure.

For both single-panelled and double-panelled structures, the typical method of installation comprises fitting the sheet material to frame sections, commonly in the form of extruded articles that may be fitted to the edge portions of the sheet material. The resultant panel and frame structure may then be mounted in a corresponding receiving structure or framework, such as a wall.

For double panelled structures, especially double-glazed windows, it is known to provide a spacer bar between the two sheets of material to ensure a correct gap between the sheets, and to seal the two sheets together to form a heat or sound barrier (i.e. a sealed unit). Such spacer bars have also been provided with perforations containing desiccant material to prevent condensation forming in the space between the sheets.

The method steps associated with the manufacture and installation of such panel structures, for example cutting, handling, edge treating, carrying, fixing and installation, in addition to the long term performance of such structures, provide many difficulties. In particular, as a result of the physical attributes of typical panel structures, such as fragility and weight, numerous problems arise. These problems can create deficiencies in, for example, quality, strength, durability and air/water-tightness, and minimising such deficiencies results in additional manufacturing/installation complexity and cost.

Furthermore, panels structures (and their component sheets) used in civil construction may be subjected to sudden impact forces of considerable magnitude or unwanted attempts to remove the sheet material from the supporting framework.

It is, therefore, desirable to realise a supporting frame assembly for sheet material that provides for reduced installation/manufacturing complexity and cost. Furthermore, it is also desirable for such frame assembly to provide improved levels of strength and resistance against impact forces (for example bomb blasts) and/or unwanted attempts to remove the sheet material.

According to a first aspect of the invention, there is provided a frame assembly for sheet material, comprising:

a plurality of inner frame sections having at least one recess for receiving the sheet material, whereby the inner frame sections can be fitted around at least part of the periphery of the sheet material;

a first outer frame for receiving the sheet material with the inner frame sections fitted thereon;

a second outer frame to be applied to the sheet material with the inner frame sections fitted thereon; and means to connect the first and second external frames together;

wherein the first and second outer frames together define a space for receiving the inner frame sections, whereby the first and second outer frames capture the sheet material with the inner frame sections fitted thereon;

holding means being provided to hold the inner frame sections in said space.

Preferably, said holding means is selected from: locking geometries of the inner frame sections and the outer frames; frictional contact; bonding/adhesives; compression clamping.

The locking geometry can advantageously be such that the inner frame sections have a neck portion and a base portion, the neck portion including a mouth of the, or each, recess; wherein the outer cross-sectional shape of the inner frame sections is such that the base portion is wider than the neck portion. The cross-sectional shape of the inner frame sections is preferably substantially triangular. Alternatively, the cross-sectional shape of the base portion of the or each inner frame section is selected from circular, regular polygonal and irregular polygonal.

In another preferred version, the inner frame sections have a substantially U-shaped cross-section. To enhance a frictional grip, there may be roughened or serrated surfaces on abutting faces of the inner frame sections and inner/outer frames. Such serration could be fine or delicately indented/patterned, and the faces may have matching indentations.

The locking geometry can include tongues and grooves on the inner frame sections and frames. Advantageously, the first and/or second outer frames include a lip which in use engages over the inner frame section. The lip is useful in preventing access and preventing the inner frame section from lifting out of the outer frame.

Thus, the invention provides a frame assembly for sheet material that reduces installation/manufacturing complexity and cost. Furthermore, a frame assembly according to the invention provides improved levels of resistance against sudden impact forces and/or unwanted attempts to remove or break through the sheet material. By matching the cross-sectional shapes of the inner frame section and the space defined by the first and second outer frames, lateral and vertical movement of the sheet material fitted in the inner frame section is hindered. Externally applied forces are also distributed over the surface of the inner frame section, the inner frame preferably being separated from the sheet material by sealing and/or bonding material.

The frame assembly may be fully "bi-directional" in its performance. That is, it may be able to withstand a bomb blast in both directions (it should be noted here that the shock waves caused by bomb blasts do generate inward and outward forces on a window).

In the invention, frames can be subsequently adapted to accommodate changes of glass thickness or change in the number of glass panels without having to remove the frames from the wall, and with full access from the inside of the building.

Further, the preferred feature of the base portion of the inner frame section being wider than the neck portion reduces the ability of the inner frame section to be levered out of the space between the first and second outer frame sections. To lever the inner frame from its assembled position, one would have to prise apart the inner frame section from the outer frame section along its entire perimeter. Such an action is seriously impeded since any rigid implement used to provide a levering force would be unable to 'wrap' around the perimeter of the inner frame in order to separate it from the outer frame sections.

There may be provided a plurality of recesses in each inner frame section, thereby enabling multi-panelled assemblies to be made. Further, this may also enable a sealed unit to be formed which is desirable for heat and sound insulation. It is envisaged that forming each inner frame section with two or three recesses will be of particular advantage. Further to this, some inner frame sections may also be provided with moisture absorbing means between each recess. In this way, condensation can be prevented from forming in the space between sheets fitted in such inner frame sections.

In one embodiment, plural inner frame sections are supported side by side on an intermediate frame section. The intermediate frame section can have two or more parallel seats for receiving the inner frame sections. This provides a way of upgrading an existing single-panelled frame assembly to a double-panelled frame assembly without discarding of the existing single panel and/or the existing outer frame sections. Thus, the frame assembly may further comprise a spacer element to increase the space between the first and second outer frames so that different sizes of inner frame sections can be fitted.

Alternatively, the first and second outer frames are provided with at least one respective projection and groove, so that their distance apart can be adjusted.

In addition the frame assembly has the ability to accommodate new (replacement) inner framed sealed structures of different sizes (length or width) when required by adding a spacer and then retightening or re-clamping the outer frame. This may allow the insertion of ballistic resistant or break-in resistant sheets of material in straight-forward manner without requiring the outer frame to be replaced. Such additional sheets of material may be made from Polycarbonate for example.

Corner pieces may be provided between the inner frame sections, the cross-sectional shape of the corner pieces corresponding to the shape of the inner frame sections. Such corner pieces reduce the complexity of fitting inner frame sections to all edges of sheet material to achieve a sealed fit. The corner pieces may also be formed with a valve for the ingress or expulsion of gas. Further, they may comprise extensions at their apexes (extending away from the sheet material), and reinforcement sections extending over the corners of the sheet material, to improve the strength of the assembly when fitted sheet material is fitted and the assembly mounted into a structure.

The frame assembly may comprise bolts or other tightening devices for bolting or tightening the second outer frame to the first outer frame, the bolts or other tightening devices being fitted transversely of (for example substantially perpendicular to) the plane of the sheet material. This allows the outer frames to be gradually urged together to minimise the possibility of the sheet material breaking due to sudden and excessive clamping pressure being applied, for example during the installation process.

In preferred embodiments of the invention, one can apply much greater clamping pressure than in conventional systems, as the frame clamp pressure is on the inner frame sections rather than the glass.

The tightening mechanism for the clamp could be in many forms. It can be tongue and groove with a bolt tightening system. It can also have block spacers to allow for different thicknesses of sealed unit.

As mentioned above, another advantage of the system is that it is fully sustainable as a frame. If one wanted to increase the system from single to double glazed, or from double to triple glazed, or to change the depth of the sealed unit, one does not have to change the frame (unlike with most conventional framed products).

Because it is not necessary to seal the inner frame sections into the frame, there is long-term flexibility in removing any broken panel or changing panels.

The cross-sectional shape of the inner frame sections may be substantially triangular. However, the cross-sectional shape of the base portion of the or each inner frame section may instead be selected from circular, regular polygonal and irregular polygonal.

The sides of the inner frame sections may be flexible, so that on clamping of the frame sections between the inner and outer frames, the inner frame sections are closed against the sheet material. This is particularly useful where the sheet material is not glass.

A mounting insert may be arranged within each recess of the inner frame sections for assisting the correct location of the sheet material in the recess.

A window or door frame assembly may be provided by the invention. Thus, in such an assembly the sheet material may be glass, clear, opaque, translucent or otherwise. The sheet material may be a panel of one material or sections of different material, placed side by side in one frame, or placed above or below in any combination. Alternatively, the frame assembly may include blinds.

By way of example, the inner and outer frame sections may be made of aluminium, steel or other metals. Alternatively, they may be formed from UPVC or other plastics or a polymer material. Of course, the inner and outer frame section may also be formed from any combination of these materials.

Although the above discussion might suggest that the frame assembly is made up of section lengths fitted around the sides of a panel, with corner pieces completing the inner frame, the inner frame sections could have mitred ends if so desired, as with the outer frames. Furthermore, the inner frame sections could extend around the corner so that in one embodiment the inner frame is made up of four L-shaped corner pieces. If a corner piece extends along a significant length of the sheet material, then functionally it may be considered as an "inner frame section" within the terms of the invention as defined herein.

According to another aspect of the invention, there is provided a corner piece for covering a corner of a panel structure having one or plural panels, the corner piece including:

a respective recess for receiving the or each panel of the panel structure such that the corner piece can be fitted around the corner of the panel structure;

wherein in the cross-section the corner piece has a neck portion and a base portion, the neck portion including a mouth of the or each recess; and wherein the outer cross-sectional shape of the corner piece is such that the base portion is wider than the neck portion.

According to yet another aspect of the invention, there is provided a method of constructing a framed panel structure having one or plural parallel panels, for example a framed window, wherein a corner piece for covering a corner of the panel structure is fitted on each corner thereof, the corner piece having a respective recess for receiving the or each panel of the panel structure such that the corner piece can be fitted around the corner of the panel structure, frame sections being fitted on the edges of the panel structure, the frame sections also having a respective recess for receiving the or each panel of the multiple panel structure, and wherein the corner pieces and frame sections have overlapping mating parts.

The gap between the corner pieces may be filled by an edge piece of the same irregular shape and size to provide a flush finish.

The above method of using corner pieces can be advantageous because with multiple panels the corner pieces space the glass (for example) at the correct distance and in the correct plane. This may be assisted by the use of plastic spacers made to fit inside the corner piece to give the correct gap for silicone sealant between glass (or any other material) and the corner piece.

The correctly spaced glass sheets can then have the vertical and horizontal frame section attached or stuck on, again in the right position to allow the right silicone gaps.

Linked to the above method, according to yet another aspect of the invention, there is provided a frame assembly for a panel structure having one or plural parallel panels, for example a framed window, comprising a corner piece for covering each corner of the panel structure, the corner piece having a respective recess for receiving the or each panel of the panel structure such that the corner piece can be fitted around the corner of the panel structure, and frame sections for fitting on the edges of the panel structure, the frame sections also having a respective recess for receiving the or each panel of the multiple panel structure, and wherein the corner pieces and frame sections have overlapping mating parts.

One of the problems with conventional windows is the seal when changing direction around the edge of the glass, i.e. the seal on the corner. In the invention the corner pieces and the vertical and horizontal frame sections overlap each other and therefore allow an efficient silicone seal in the overlap area. This provides for convenient sizing/cutting tolerances. In practice the frame sections are slightly undercut in length to allow a good seal between the corner pieces and the frame sections.

The overlapping parts of the corner pieces and frame sections may be formed with respective projections and recesses, so that they slot together. If these projections and recesses have parallel sides, then the frame sections can be pushed onto the corner pieces (already mounted on the panels). If the projections and recesses are wedge-shaped (as in a conventional tongue-and-groove), then the frame sections are slid onto the corner piece, along the edge of the panels.

Preferably, the inner frame sections and the corner piece are of the same dimensions and size in cross-section so that they are flush-fitting, but they may sometimes not be flush-fitted to fit a particular application.

The corner pieces can also contain an already fitted valve system, if required, to allow other gasses to be inserted into a sealed unit to replace the air, or to provide a partial or total vacuum.

The invention further provides a corner piece for covering a corner of a panel structure having plural panels, the corner piece including a recess for receiving each panel of the multiple panel structure such that the corner piece can be fitted around the corner of the multiple panel structure with each panel in its respective recess. In a related embodiment of the invention, there is provided the use of a plurality of such corner pieces to hold plural panes of a multiple panel structure in parallel relationship, for further fitting, for example in double or triple glazing.

Examples of the invention will now be described in detail with reference to the accompanying drawings, in which.

Figure 4A:
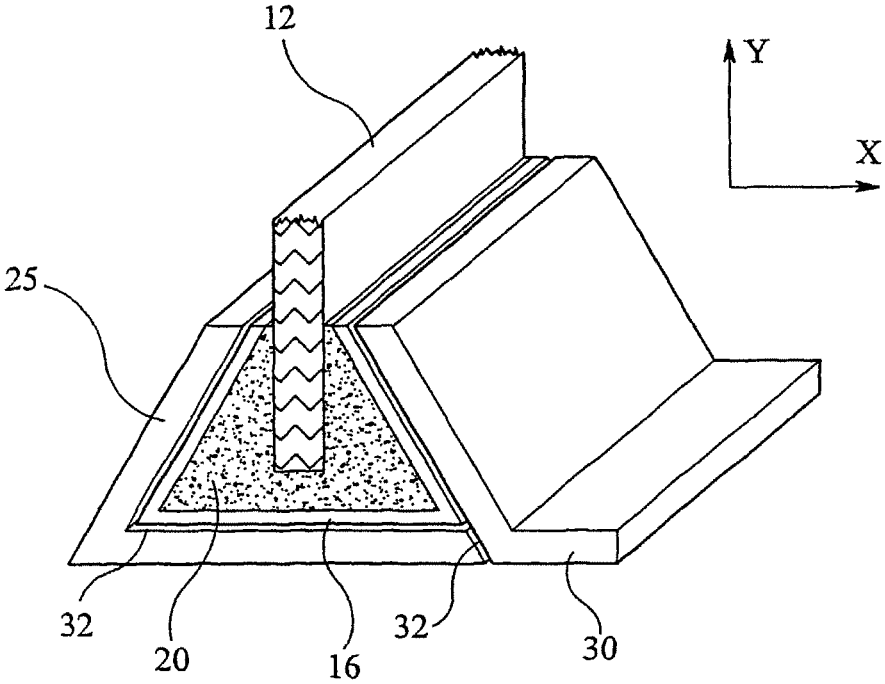
Figure 4B:
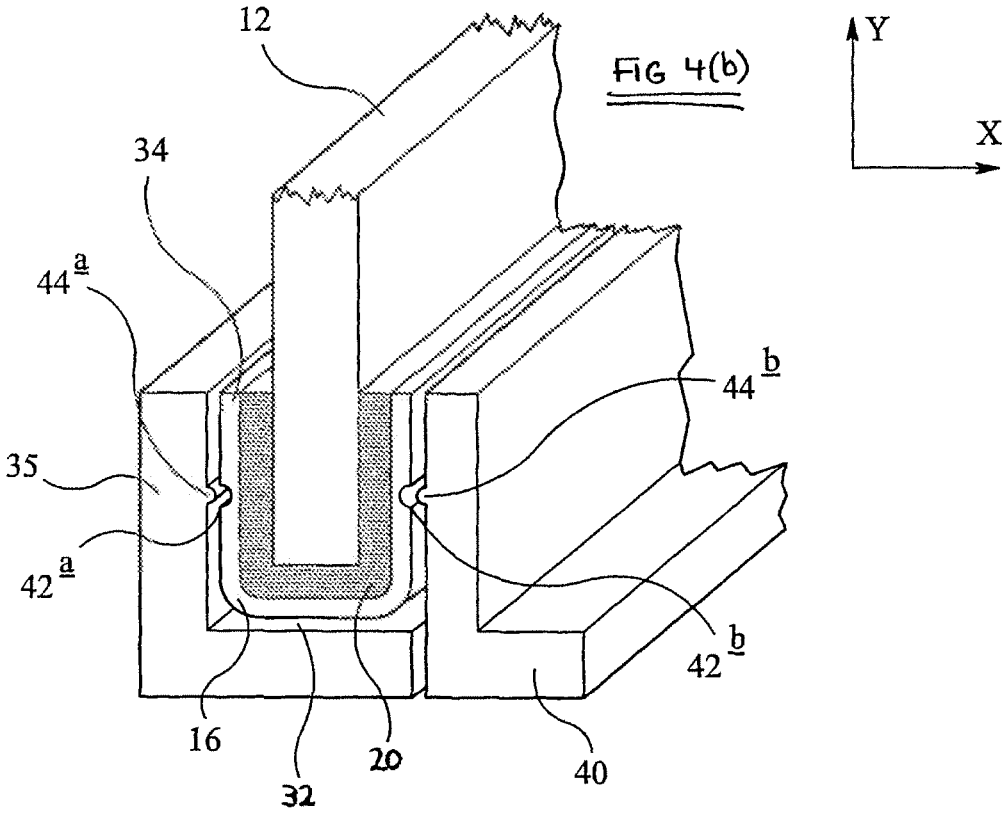
Figure 4C:
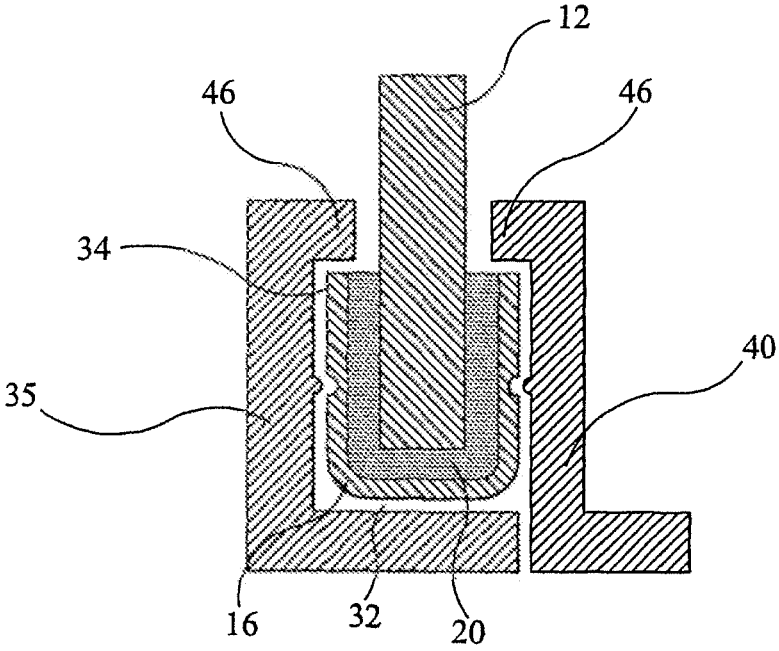

FIG. 4*a* is a perspective view of an assembly according to an embodiment of the invention;

FIG. 4*b* is a perspective view of an assembly according to an alternative embodiment of the invention;

FIG. 4*c* is a cross-section of a modification of the embodiment of FIG. 4*b;*

Figure 1:
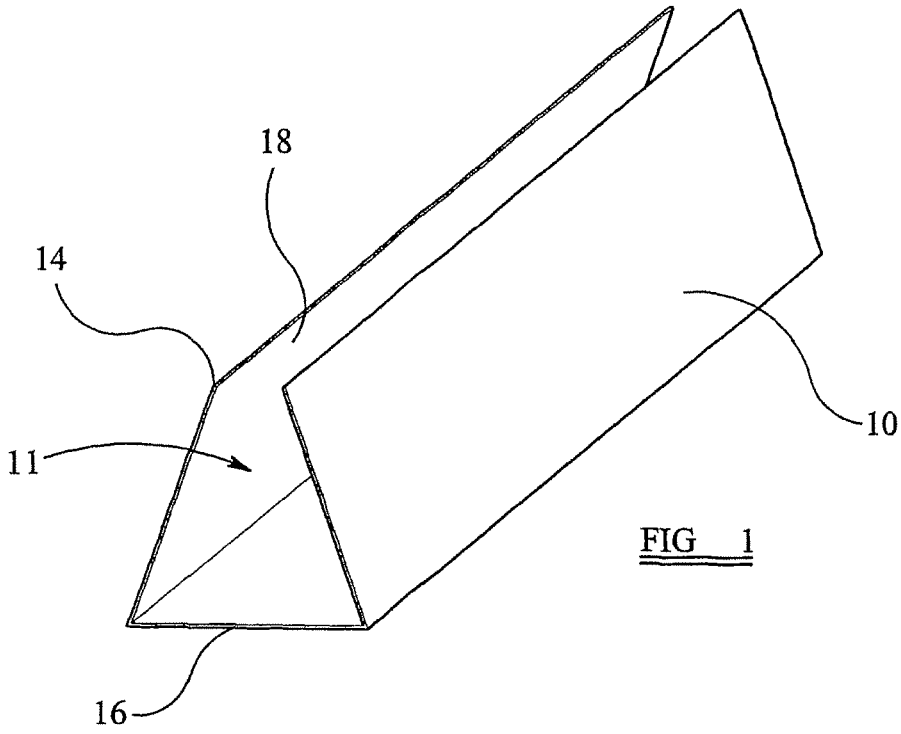
FIG. 1 is a perspective view of an inner frame section in accordance with an exemplary embodiment of the invention.
Figure 5A:
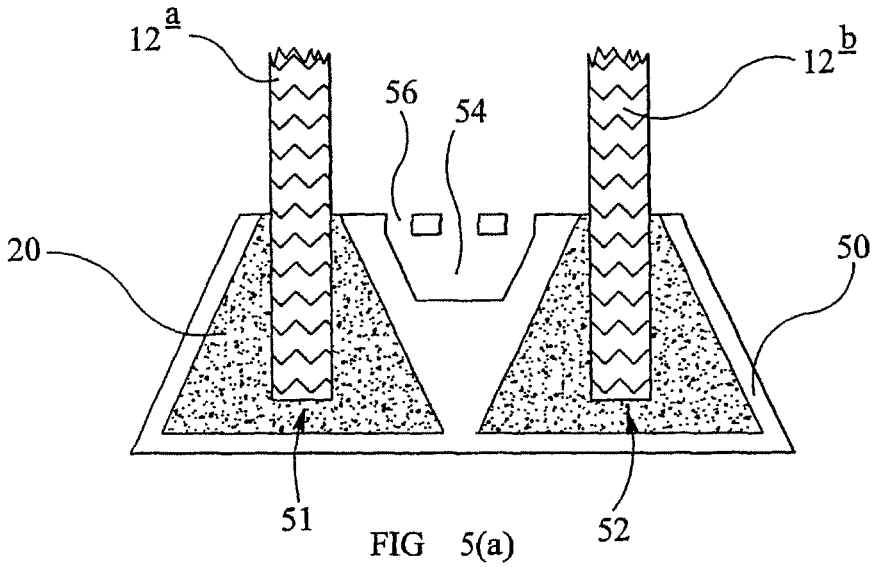
Figure 5B:
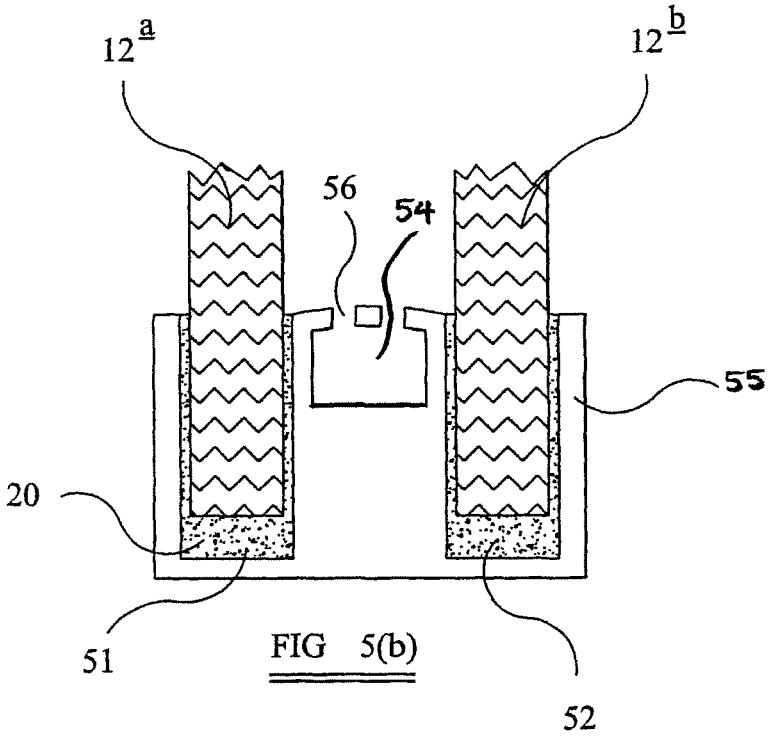
Figure 6:
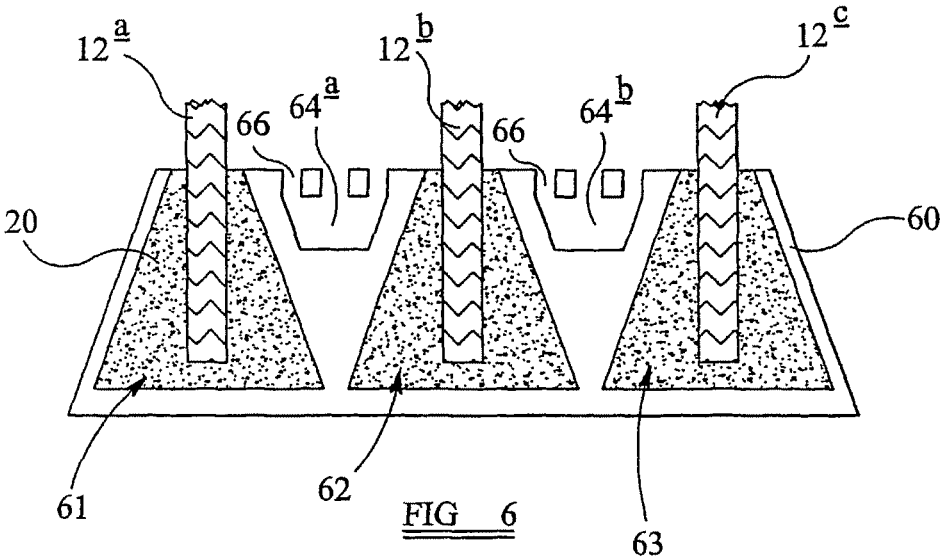
Figure 7A:
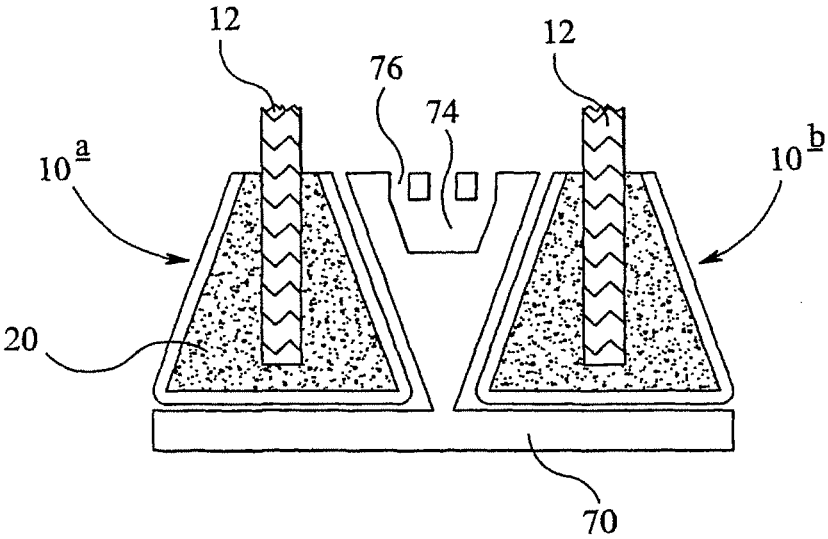
Figure 7B:
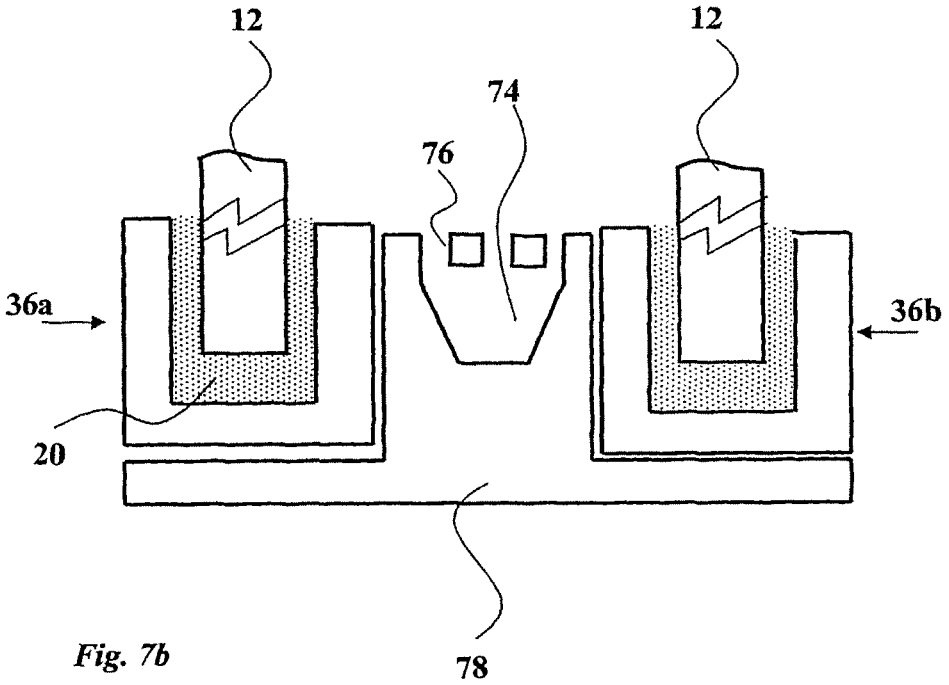
Figure 8A:
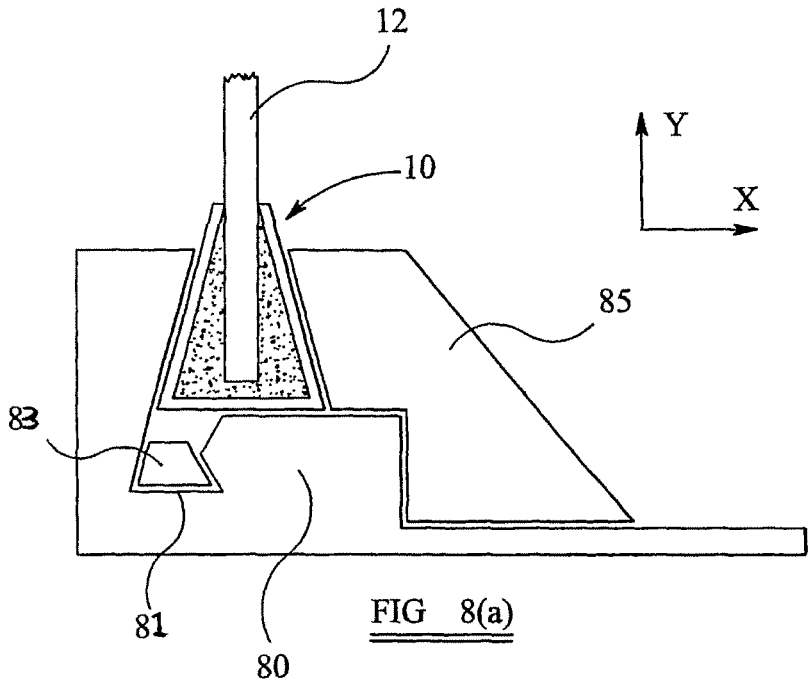
Figure 8B:
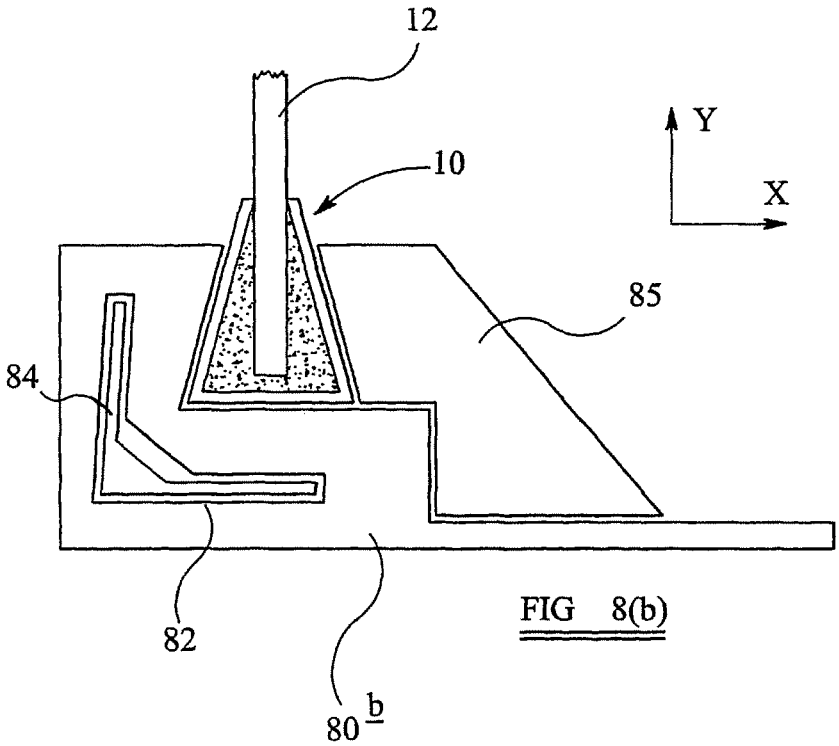

FIG. 5*a* is a cross-section of an inner frame section according to an embodiment of the invention, wherein the inner frame section is fitted to first and second sheets of material;

FIG. 5*b* is a cross-section of an inner frame section according to an alternative embodiment of the invention, wherein the inner frame section is fitted to first and second sheets of material;

FIG. 6 shows a modification of the embodiment of FIG. 5, wherein the modified inner frame section is fitted to first to third sheets of material;

FIG. 7*a* is a cross-section of an intermediate frame section according to an embodiment of the invention, wherein the intermediate frame section is arranged to receive first and second inner frame sections of FIG. 1;

FIG. 7*b* is a cross-section of an intermediate frame section according to an alternative embodiment of the invention, wherein the intermediate frame section is arranged to receive first and second generally U-shaped inner frame sections;

FIG. 8*a* is a cross-section of an assembly according to an embodiment of the invention;

FIG. 8*b* shows a modification of the embodiment of FIG. 8*a;*

Figure 8C:
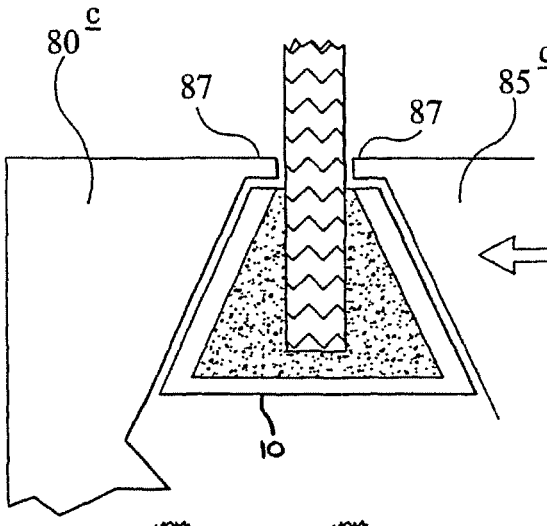

FIG. 8*c* shows another modification of the embodiment of FIG. 8*a;*

Figure 8D:
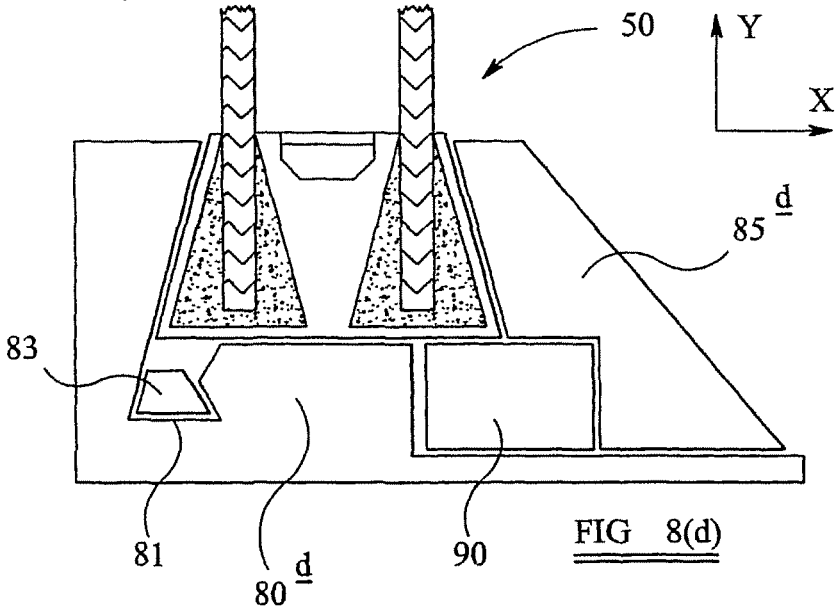

FIG. 8*d* shows yet another modification of the embodiment of FIG. 8*a;*

Figure 8E:
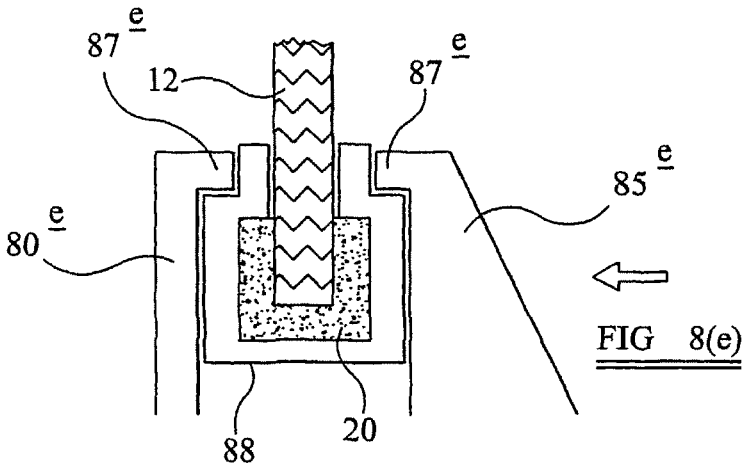

FIG. 8*e* shows a different modification of the embodiment of FIG. 8*a;*

Figure 9A:
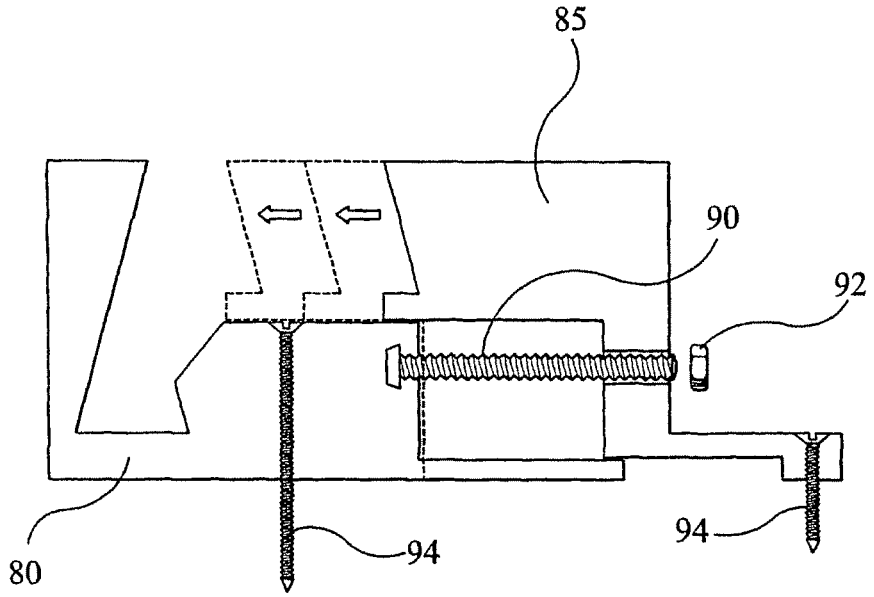
Figure 9B:
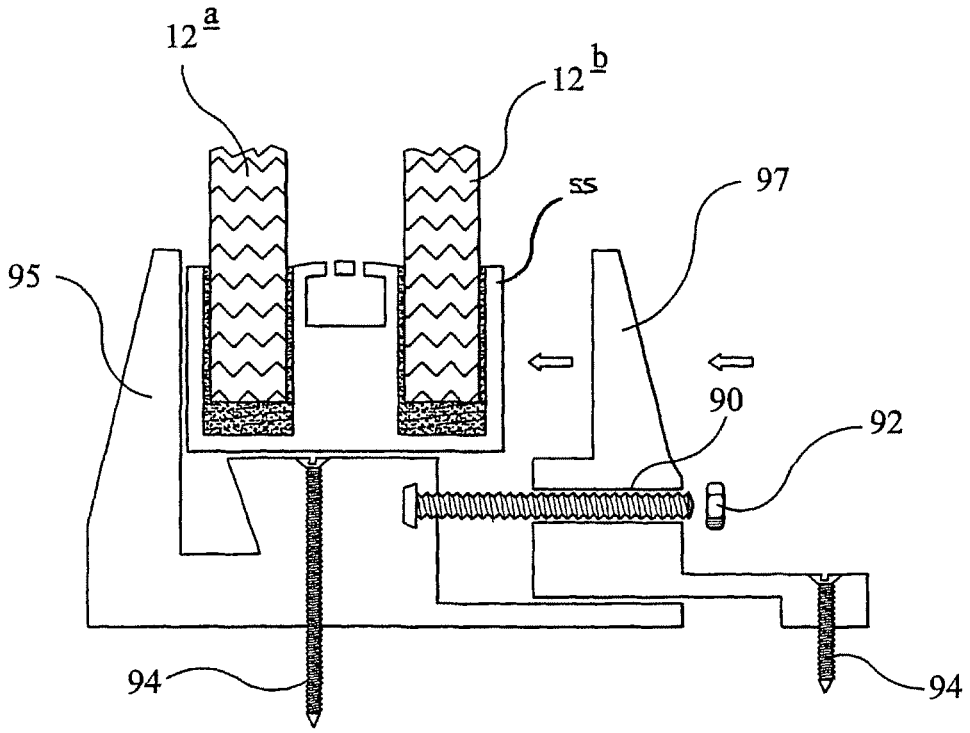
Figure 9C:
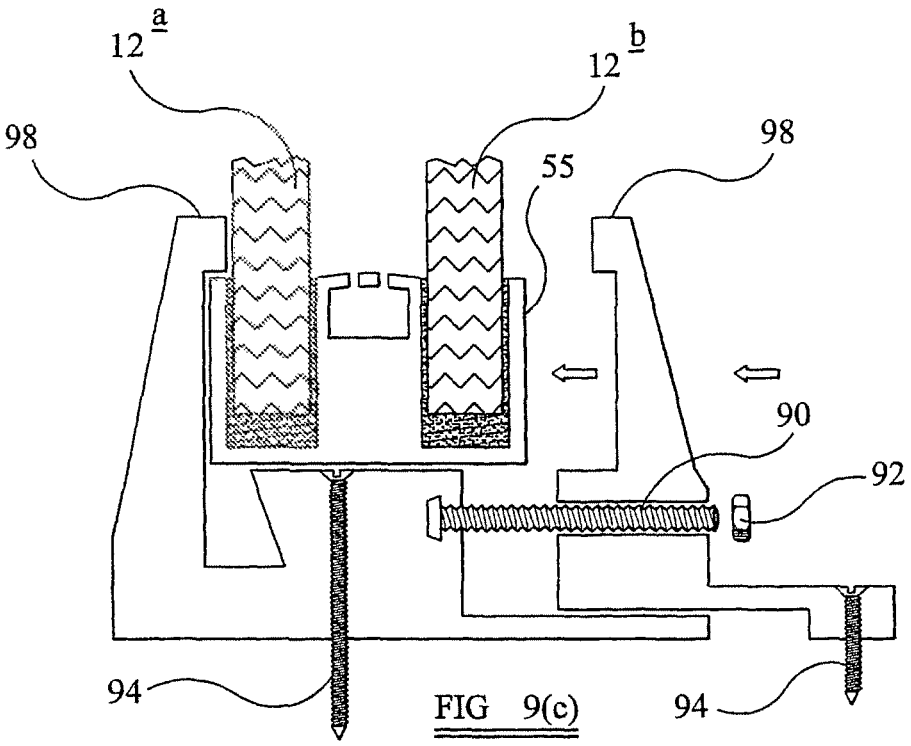

FIG. 9*a* is a cross-section of first and second outer frame sections in accordance with the invention;

FIG. 9*b* is a cross-section of an assembly according to an alternative embodiment of the invention;

FIG. 9*c* shows a modification of the embodiment of FIG. 9*b;*

Figure 9D:
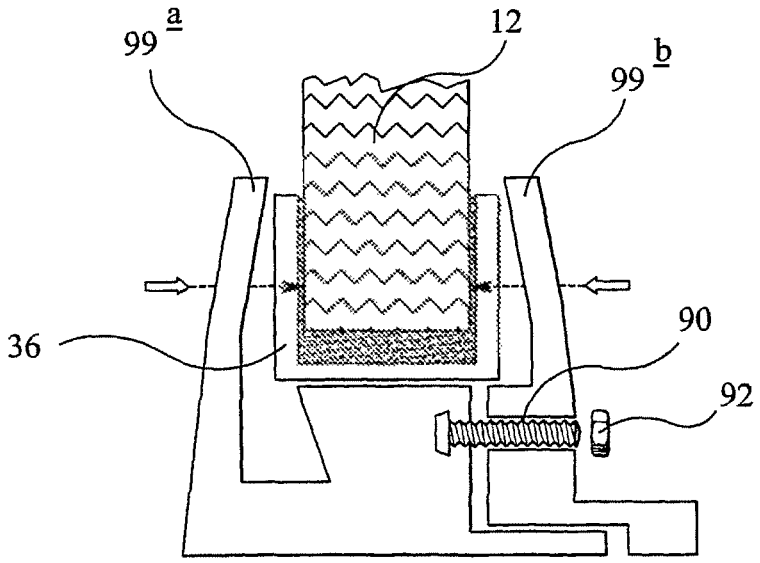
Figure 9E:
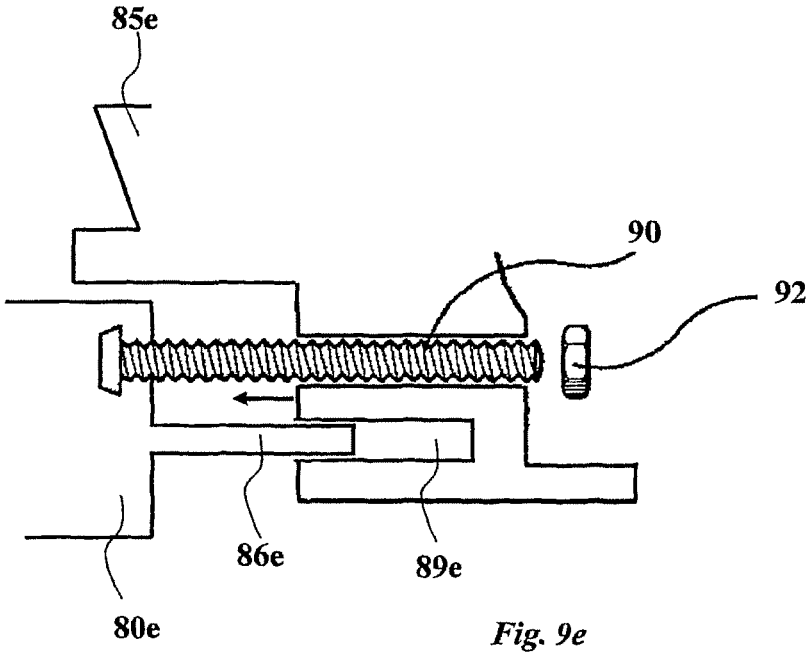

FIG. 9*d* is a cross-section of an assembly according to yet another alternative embodiment of the invention;

FIG. 9*e* illustrates a modification of the first and second outer frame sections shown in FIG. 9*a;*

Figure 9F:
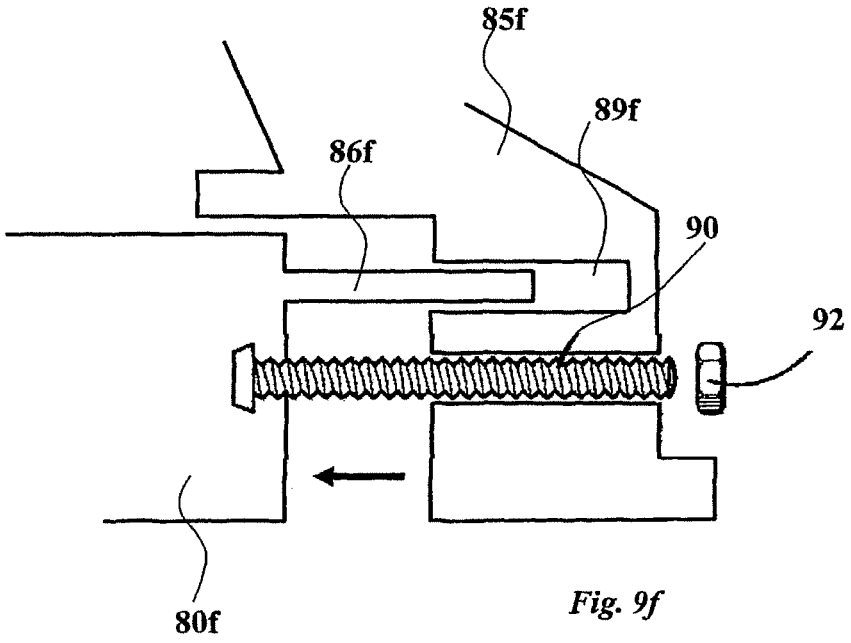

FIG. 9*f* illustrates another modification of the first and second outer frame sections shown in FIG. 9*a;*

Figure 10A:
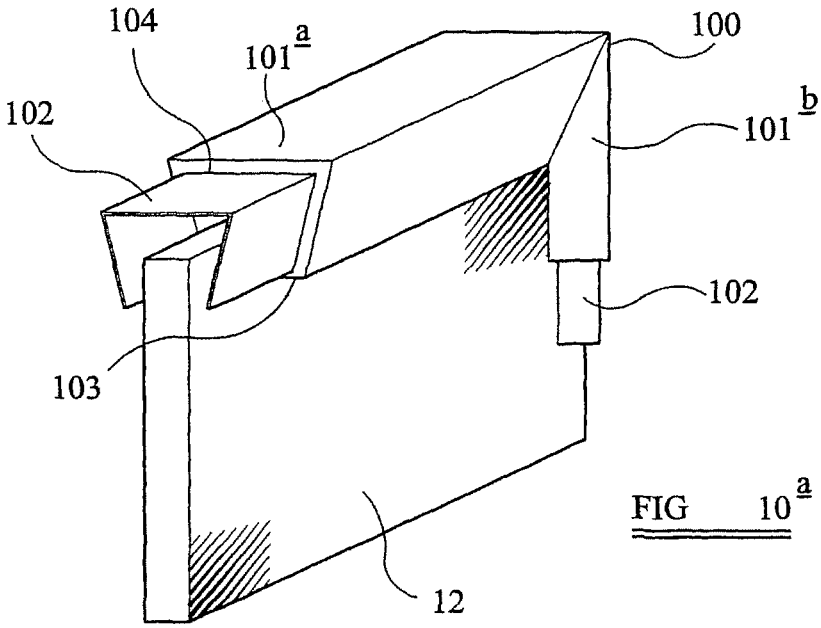
Figure 10B:
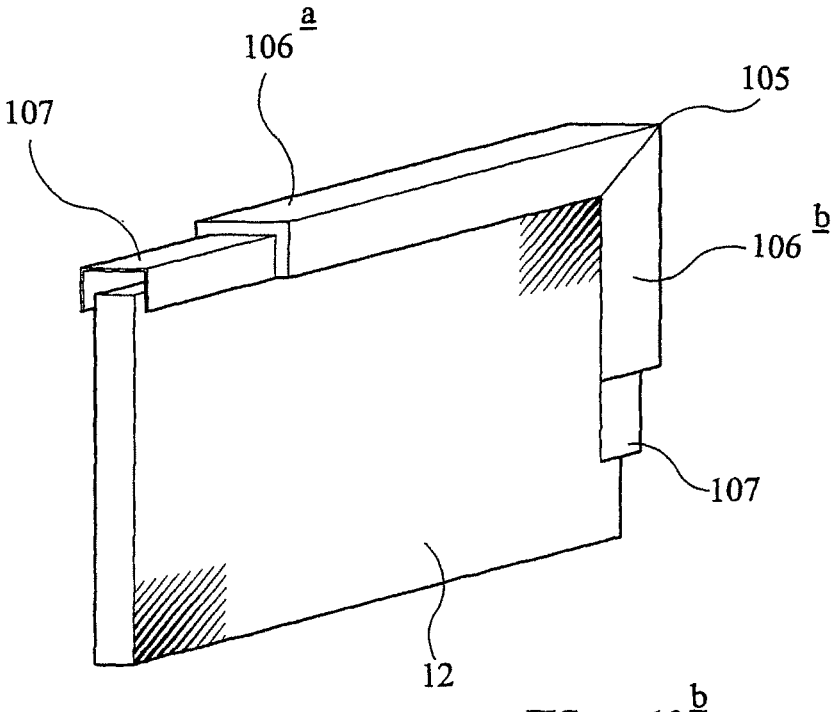
Figure 11A:
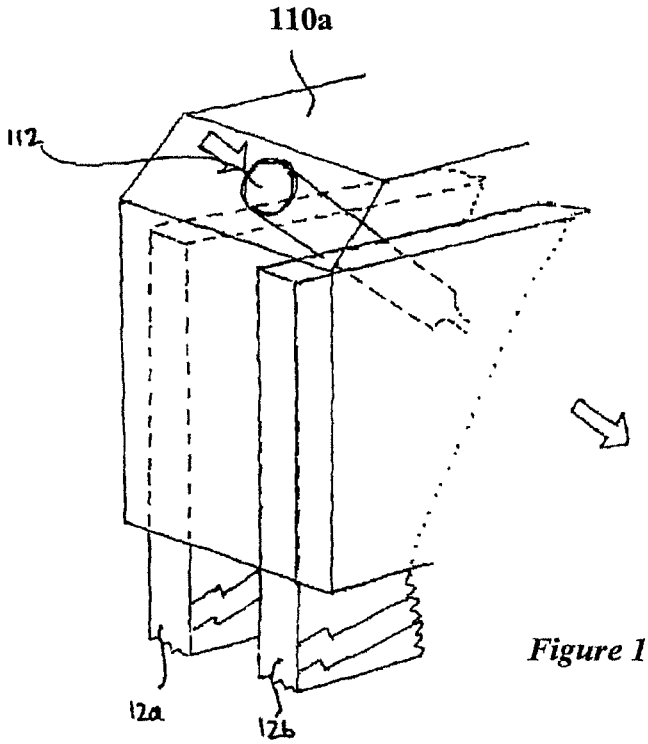

FIG. 10*a* is a perspective view of a corner piece according to the invention;

FIG. 10*b* is a perspective view of a corner piece in accordance with an alternative embodiment of the invention;

FIG. 11*a* shows a modification of the corner piece shown in FIG. 10*a;*

Figure 11B:
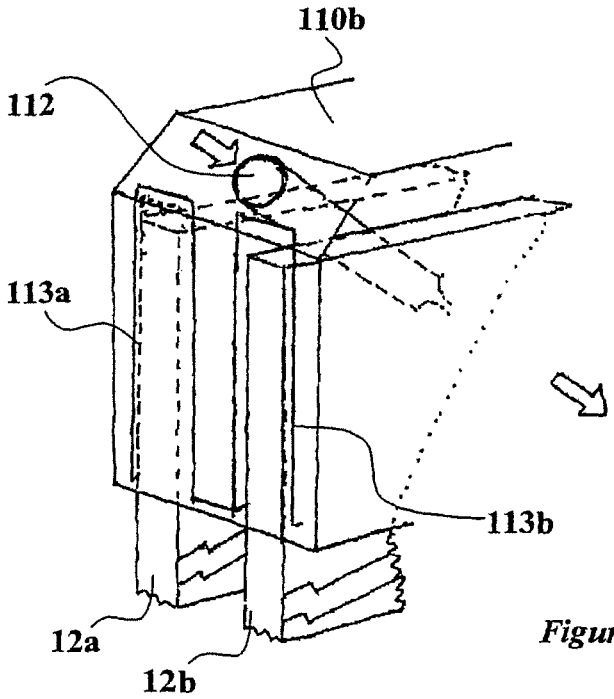

FIG. 11*b* shows an alternative modification of the corner piece shown in FIG. 10*a;*

Figure 11C:
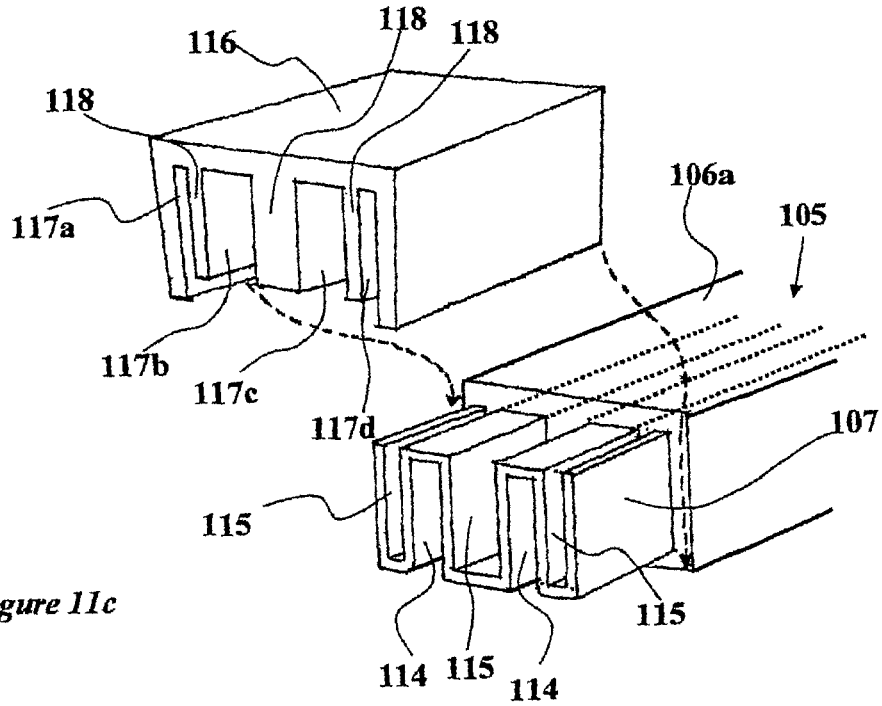

FIG. 11*c* shows a modification of the corner piece shown in FIG. 10*b;*

Figure 11D:
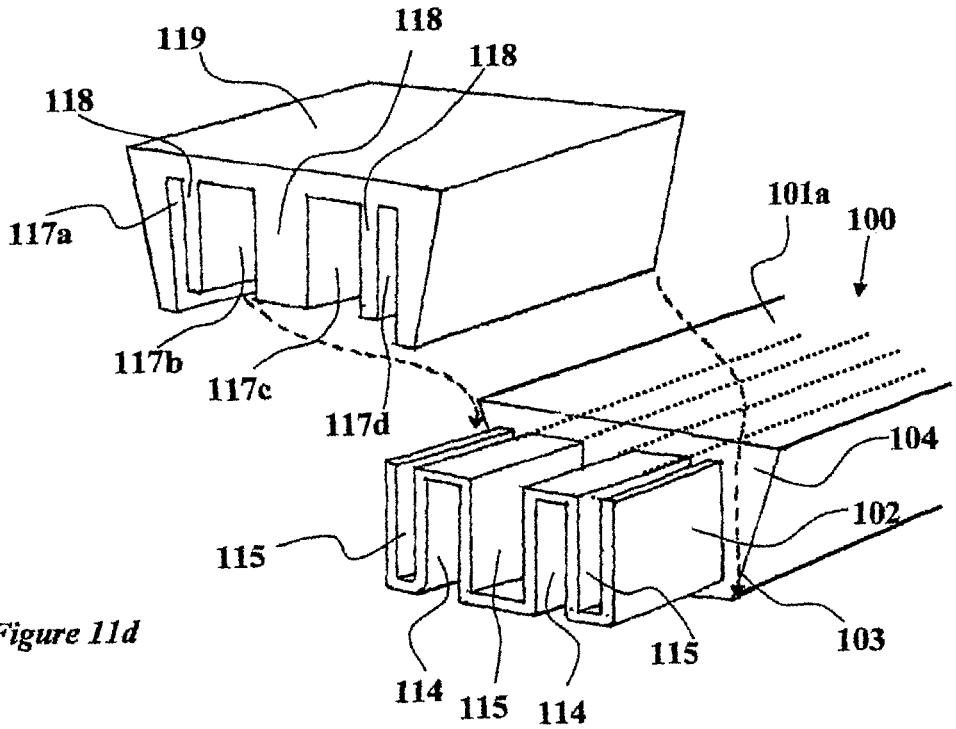

FIG. 11*d* shows another modification of the corner piece shown in FIG. 10*a;*

Figure 11E:
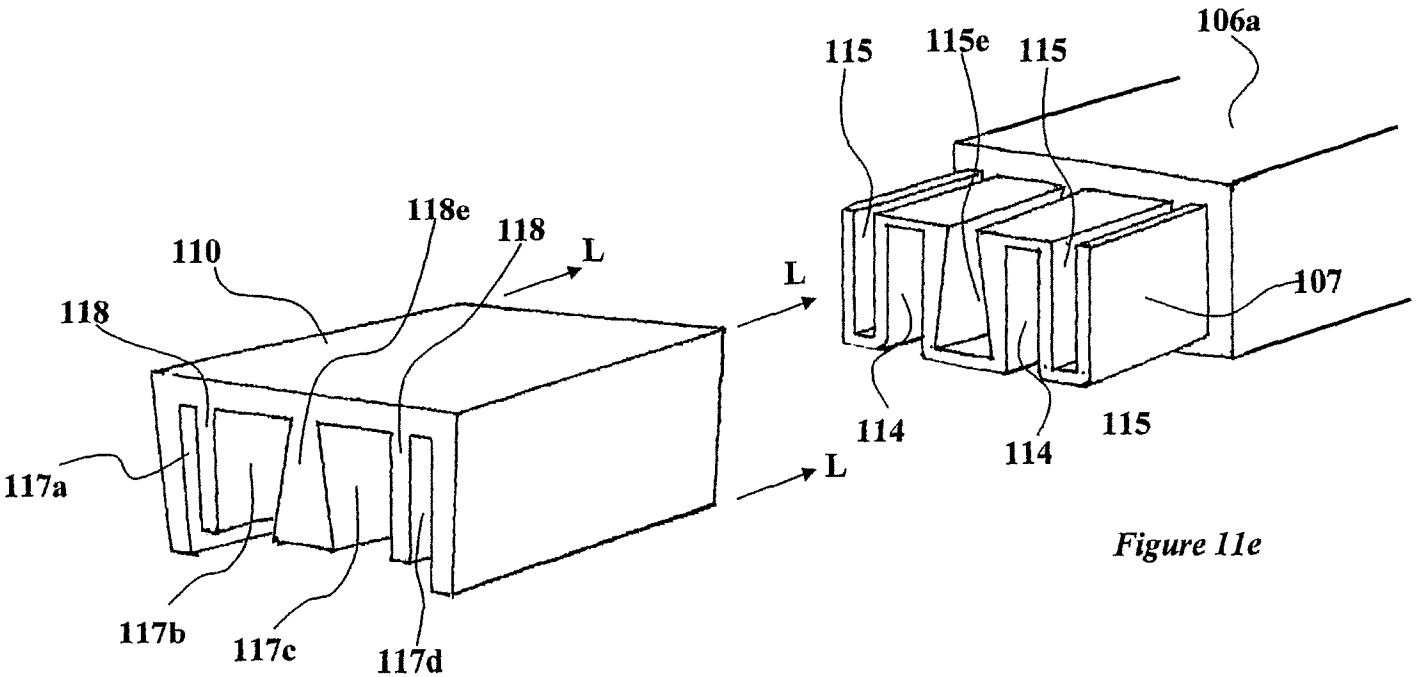

FIG. 11*e* shows a modification of the corner piece of FIG. 11*c;*

Figure 12A:
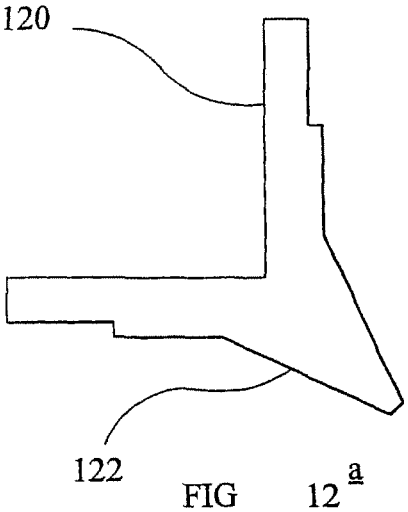
Figure 12B:
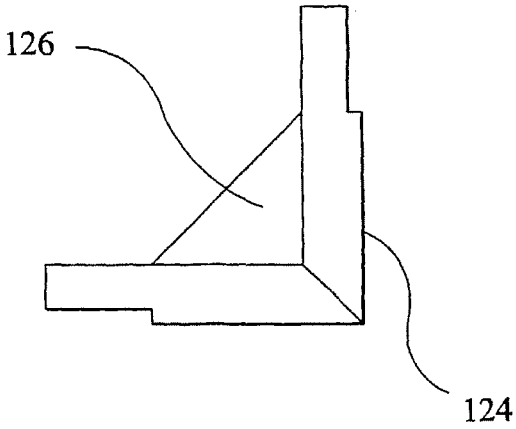

FIGS. 12*a* and 12*b* shows further modifications to the corner piece of FIG. 10*a;*

Figure 2:
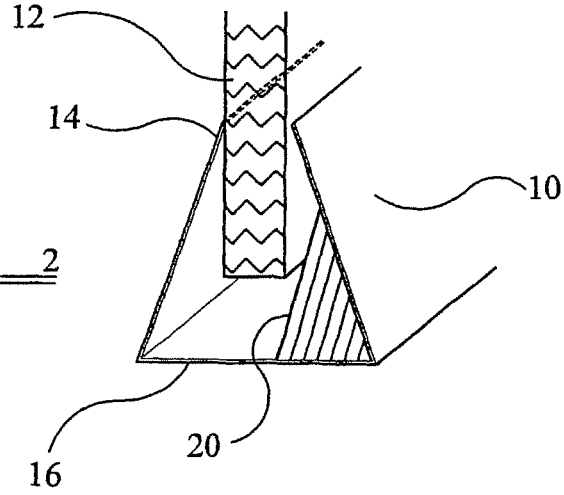
FIG. 2 shows the inner frame section of FIG. 1 fitted to an edge of sheet material.
Figure 13:
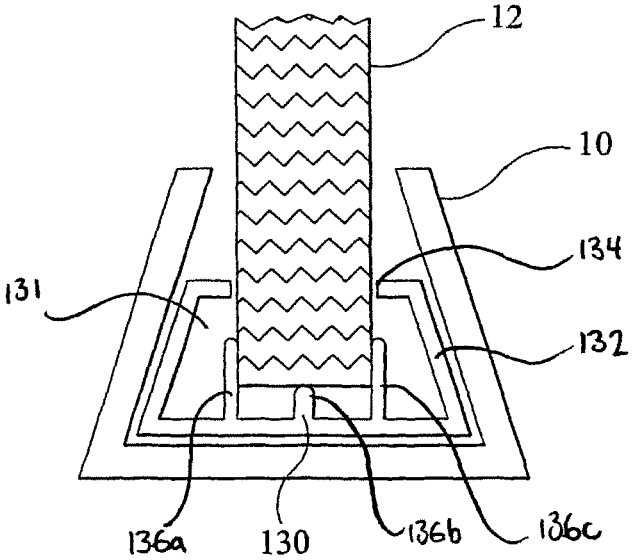
Figure 14:
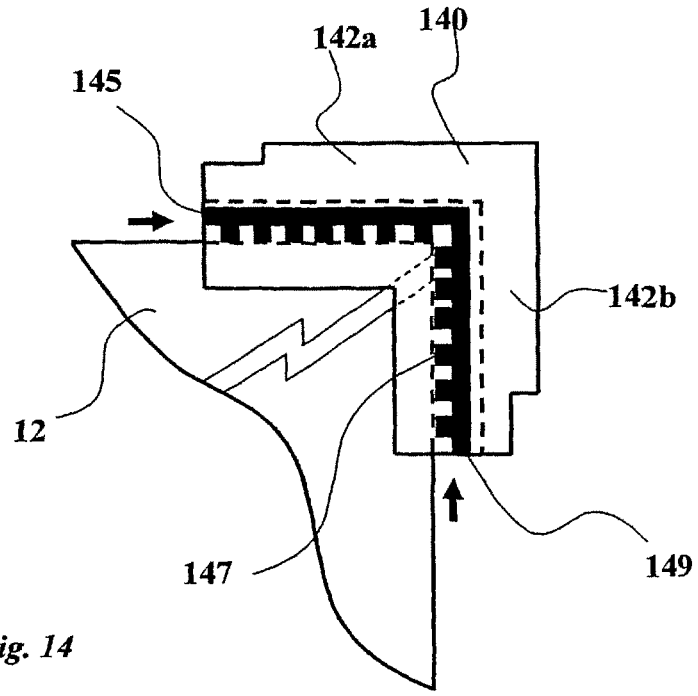
Figure 15A:
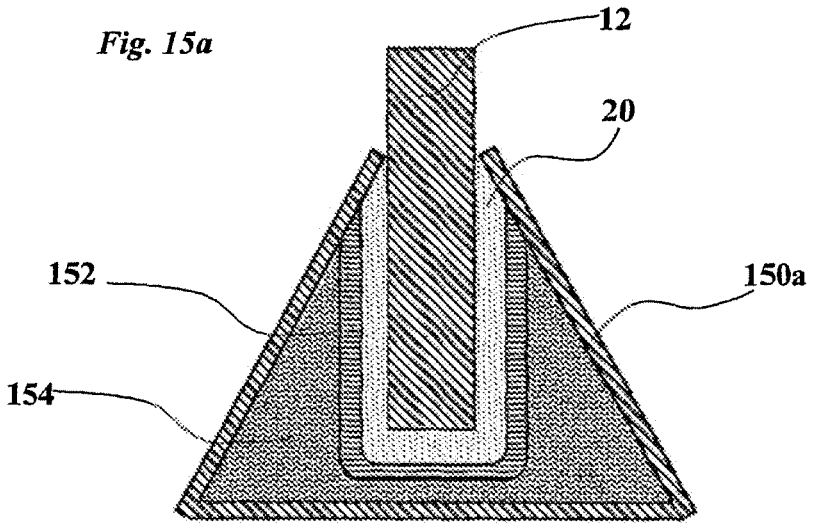
Figure 15B:
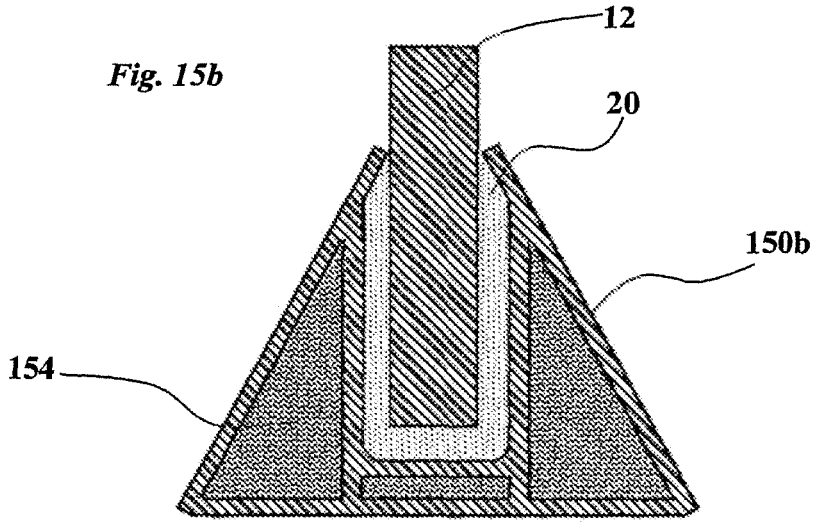
Figure 16A:
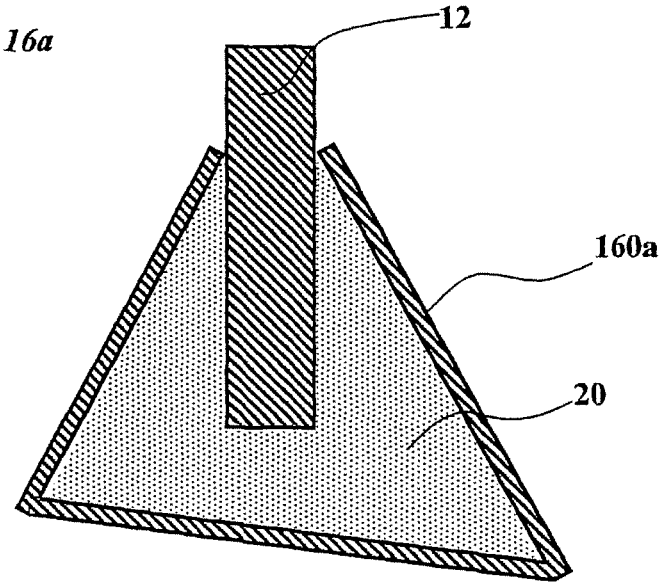
Figure 16B:
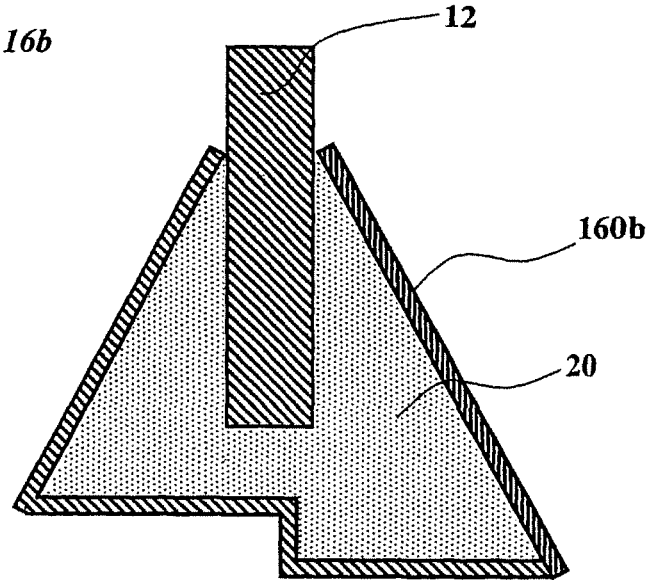
Figure 17:
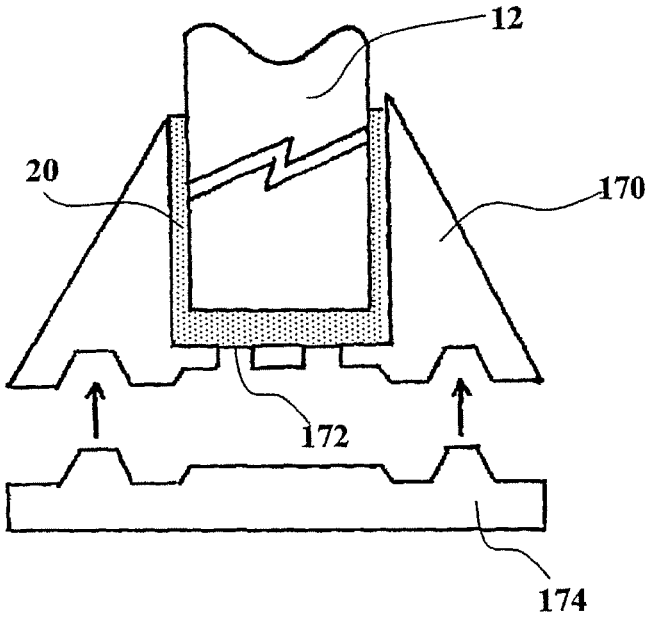
Figure 18:
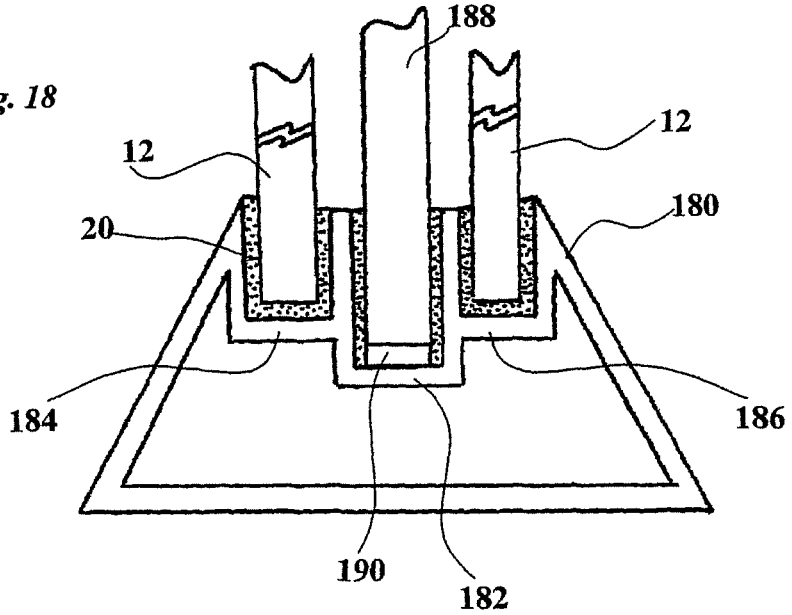
Figure 20:
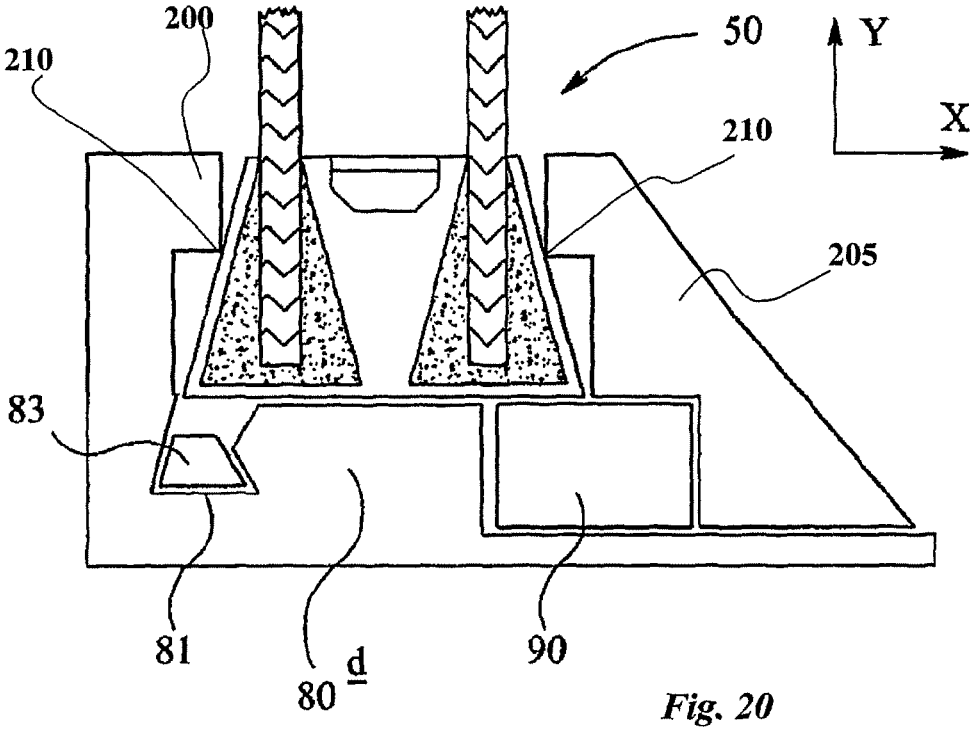

FIG. 13 shows a modification of the inner frame section shown in FIG. 2;

FIG. 14 illustrates a corner piece according to an embodiment of the invention, wherein the corner piece is fitted to a sheet of material;

FIGS. 15*a* and 15*b* are cross-sections of an inner frame section according to alternative embodiments of the invention, respectively, wherein each inner frame section is fitted to a sheet of material;

FIGS. 16*a* and 16*b* are cross-sections of an inner frame section according to further alternative embodiments of the invention, respectively, wherein each inner frame section is fitted to a sheet of material;

FIG. 17 is a cross-section of an intermediate frame section according to an embodiment of the invention, wherein the intermediate frame section is arranged to receive an inner frame section according to an alternative embodiment of the invention;

FIG. 18 is a cross-section of an inner frame section according to an alternative embodiment of the invention, wherein the inner frame section is fitted to first, second and third sheets of material;

FIGS. 19*a* to 19*c* illustrate exemplary shapes of inner frame sections according to the invention; and FIG. 20 is a cross-section of an assembly according to an embodiment of the invention.

Referring to FIGS. 1 and 2 an elongate extruded inner frame section 10 has a recess 11 for receiving sheet material 12, such as glass. The inner frame section 10 can be fitted around the periphery of the sheet material, for example the edge of a glazing sheet.

The inner frame section has a neck portion 14 and a base portion 16, the neck portion 14 including a mouth 18 of the recess 11. The edge of the sheet material 12 is inserted into the recess 11 through the mouth 18 and surrounded by a sealing and/or bonding material 20 provided in the recess 1. In the embodiment illustrated, the recess is filled with a silicon bonding material 20 so that the edge of the sheet material 12 is surrounded by the bonding material 20 and is held in position by the bonds formed between the inner frame section 10, the bonding material 20 and the sheet material 12.

Preferably, the bonding material 20 is provided in the recess 11 such that it is sandwiched between the mouth 18 and the sheet material 12 in order to prevent the sheet material 12 contacting the inner frame section 10. In other words, it is preferred to separate the sheet material 12 from the inner frame section 10 by a sealant material to avoid the inner frame section 10 exerting a force on the sheet material 12 directly.

To provide suitable strength and allow for ease of manufacture, for example by extrusion, the inner frame section 10 may be made of aluminium, steel, UPVC or other plastics or polymer material. Such materials are purely exemplary since the inner frame may be formed from any suitable material.

In the illustrated embodiment, the inner frame section 10 is formed from aluminium and has a thickness of between 2-5 mm. Also, the cross-sectional shape of the recess 11 is illustrated as corresponding to the outer cross-sectional shape of the inner frame section 10. Of course, it will be appreciated that the inner frame section may be of greater, lesser or varying thickness in alternative embodiments.

In the embodiment of FIGS. 1 and 2, the cross-sectional shape of the inner frame section is substantially triangular. It is envisaged that it may be preferable that the angle defined between the base portion 16 and the neck portion 14 be of a value between 30-60° to allow for varying thicknesses of sheet material 12. This will be understood when one views the neck portion 14 as providing a clamping function, whereby the width of the receiving mouth 18 may be varied according to the thickness of sheet material 12.

It will be appreciated that the depth of the recess 11 (i.e. the vertical distance between the mouth 18 and the base portion 16) may be of any suitable value. However, it is preferable that the sheet material 12 is inserted into the recess 11 to a maximum available depth (whilst ensuring a finite amount of bonding material is provided under the sheet material 12, i.e. between the sheet material 12 and the base portion 16), such that a maximal area of the sheet material 12 is contained with in the recess 11 for a given recess 11 depth. Purely by way of an example, the depth of the recess in the illustrated embodiment is approximately 25 mm.

As illustrated in FIG. 3, the cross-sectional shape of the inner frame section 10 may be of any other suitable shape, such as one selected from 'U'-shaped, circular, regular polygonal and irregular polygonal. It is noted that the cross-sectional shape selected for the inner frame section in FIGS. 3*a*-3*g* is subject to a preferred requirement that the base portion 16 is wider than the neck portion 14. However, as illustrated with the substantially 'U'-shaped cross-section of FIG. 3*h*, it is not essential to arrange the base portion 16 to be wider than the neck portion 14.

Referring to FIG. 4*a*, a frame assembly according to an embodiment of the invention comprises the inner frame section 10 of FIGS. 1 and 2, and first 25 and second 30 elongate extruded outer frame sections. The first outer frame section 25 is arranged to receive sheet material 12 with an inner frame section 10 fitted thereon. The second outer frame section 30 is then arranged to be applied to the inner frame section 10 with the sheet material being cushioned in silicon inside inner frame section 10.

The first 25 and second 30 outer frame sections together define a space whose shape corresponds to that of the outer cross-sectional shape of the inner frame section 10. In this way, the inner frame section 10 is sandwiched between the first 25 and second 30 outer frame sections such that the first 25 and second 30 outer frame sections capture the inner frame section 10.

In the embodiment of FIG. 4*a*, the first 25 and second 30 external frame sections are bonded together using adhesive 32. Of course, any such suitable fixing means may alternatively be used in order to fix the external frame sections together with the inner frame section therebetween. The first 25 and second 30 external frame sections are also bonded to the inner frame section 10 at their surfaces of contact. Although bonds formed between the inner frame section 10 and the external frame sections may be preferable, such bonds are not essential to the invention, since the inner frame section 10 is captured between the external frame sections.

The reader will appreciate that the first 25 and second 30 outer frame sections cooperate to retain the inner frame section. The outer frame sections restrict movement of the inner frame section 10 in the lateral direction (the direction indicated generally by the arrow labelled 'X') since they are locked together. Also, by together defining a space whose shape corresponds to that of the outer cross-sectional shape of the inner frame section, the outer frame sections restrict movement of the inner frame section 10 in the vertical direction (the direction indicated generally by the arrow labelled 'Y') because the base portion 16 of the inner frame section 10 is wider than its neck portion 14.

The triangular, or 'wedge-like', cross-sectional shape of the inner frame section 10 and space defined by the first 25 and second 30 outer frame sections is preferable because it allows for variations in the size of the inner frame section 10, for example due to manufacturing tolerances. In the situation where the size of the inner frame section is smaller than the space defined the first 25 and second 30 outer frame sections, arrangement of the outer frame sections as illustrated in FIG. 4 will capture the inner frame section 10 at a position where it is raised vertically (at a position where the width of the inner frame section 10 corresponds to that of the space defined by the outer frame sections). In other words, because the width of the inner frame section 10 increases from the neck portion 14 to the base portion 16, and the width of the space defined by the outer frame sections decreases from bottom to top, differing sizes of inner frame sections 10 (with a triangular cross-sectional shape) will be clamped within a space of triangular cross-sectional shape at differing vertical positions within the space. This feature provides the significant advantage that the outer frame sections are capable of securing inner frame sections of differing sizes. In the field of manufacturing, within which it can be difficult and costly to make products with little to no variation in shape and/or size, the provision of increased levels of tolerance whilst still enabling the performance of a function is highly desirable. It will also allow contraction and expansion of the flat materials encased in the unit.

As before, to provide suitable strength and allow for ease of manufacture, the first 25 and second 30 outer frame sections may be made of aluminum, steel, UPVC or other plastics or polymer material, notwithstanding the possibility of using any suitable material to be developed in the future.

Figure 3A:
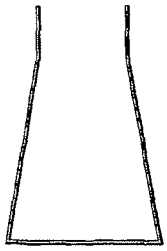
FIG. 3A illustrates a first exemplary cross-sectional shape of an inner frame section according to the invention.
Figure 3B:
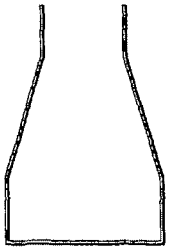
FIG. 3B illustrates a second exemplary cross-sectional shape of an inner frame section according to the invention.
Figure 3C:
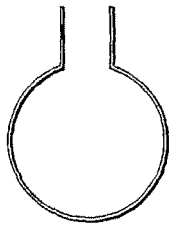
FIG. 3C illustrates a third exemplary cross-sectional shape of an inner frame section according to the invention.
Figure 3D:
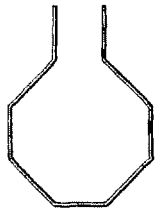
FIG. 3D illustrates a fourth exemplary cross-sectional shape of an inner frame section according to the invention.
Figure 3E:
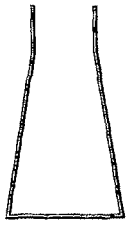
FIG. 3E illustrates a fifth exemplary cross-sectional shape of an inner frame section according to the invention.
Figure 3F:
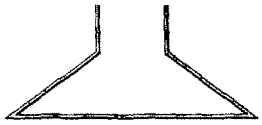
FIG. 3F illustrates a sixth exemplary cross-sectional shape of an inner frame section according to the invention.
Figure 3G:
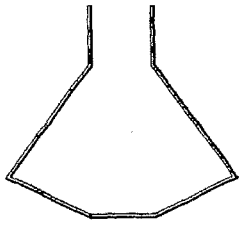
FIG. 3G illustrates a seventh exemplary cross-sectional shape of an inner frame section according to the invention.
Figure 3H:
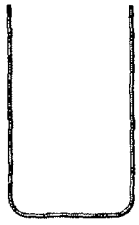
FIG. 3H illustrates an eighth exemplary cross-sectional shape of an inner frame section according to the invention.

Referring to FIG. 4*b*, a frame assembly according to an alternative embodiment of the invention comprises an inner frame section 34 of FIG. 3*h*, and first 35 and second 40 elongate extruded outer frame sections. Thus, the inner frame section 34 has a substantially U-shaped cross-section. The first outer frame section 35 is arranged to receive sheet material 12 with an inner frame section 34 fitted thereon. The second outer frame section 40 is then arranged to be applied to the sheet material 12 with the inner frame section 34 fitted thereon.

The first 35 and second 40 outer frame sections together define a space whose shape corresponds to that of the outer cross-sectional shape of the inner frame section 34. Thus, as with the previous embodiment of FIG. 4*a*, the inner frame section 34 is sandwiched between the first 35 and second 40 outer frame sections such that the first 35 and second 40 outer frame sections capture the sheet material 12 with the inner frame section 34 fitted thereon.

In the embodiment of FIG. 4*b*, the first 35 and second 40 external frame sections are bonded together using adhesive 32. Of course, any such suitable fixing means may be used in order to fix the external frame sections together with the inner frame section therebetween. The first 35 and second 40 external frame sections are also bonded to the inner frame section 34 at their surfaces of contact. Although bonds are formed between the inner frame section 34 and the external frame sections may be preferable, such bonds are not essential to the invention, since the inner frame section 34 is captured between the external frame sections.

To provide suitable strength and allow for ease of manufacture, the first 35 and second 40 outer frame sections may be made of aluminium, steel, UPVC or other plastics or polymer material, notwithstanding the possibility of using any suitable material to be developed in the future.

In order to enhance a frictional grip, there may be roughened or serrated surfaces on abutting faces of the inner frame sections and external frame sections. Such serration could be fine or delicately indented/patterned. Further, the faces may have matching indentations.

As illustrated in FIG. 4*b*, the locking geometry of the inner frame section 34 and the external frame sections 35 and 40 may include two tongue and groove arrangements. Grooves 42*a* and 42*b* are provided along the longitudinal length of the inner frame section 34 on its opposite outer surfaces. Corresponding tongues 44*a* and 44*b* are formed on the faces of each external frame sections which abut the inner frame section 34. To allow for manufacturing tolerances, the grooves 42*a* and 42*b* are preferably of greater width and/or depth than the tongues 44*a* and 44*b*.

As before, the first 35 and second 40 outer frame sections cooperate to retain the inner frame section 34. The outer frame sections restrict movement of the inner frame section 34 in the lateral direction (the direction indicated generally by the arrow labelled 'X') since they are locked together. Also, a combination of frictional forces, bonding forces and the tongue and groove arrangements restrict movement of the inner frame section 34 in the vertical direction (the direction indicated generally by the arrow labelled 'Y').

To further restrict vertical movement of the inner frame section, the first 35 and second 40 outer frame sections may also include a lip which, in use, engages over the inner frame section 34. Such a preferred arrangement is illustrated in FIG. 4*c*. The lip of each of the outer frame sections is positioned above the inner frame section 34 to impede its vertical movement.

The embodiment of FIG. 4*c* has been illustrated with a gap between each lip and the inner frame section 34. This is to allow for manufacturing tolerances, contraction and expansion of sheet materials, and/or different sizes of the inner frame section 34 captured by the outer frame sections. The size of the illustrated gap in relation to the dimensions of the assembly is for illustrative purposes only and, accordingly, it should be not be taken as exact or limiting. In fact, alternative embodiments may be arranged such that the lips contact the inner frame section 34 in use, or such that rubber material is provided therebetween. In this way, ingress of water, and the like, into any part of the frame assembly can be hindered or prevented. The provision of expandable material between the lips and the inner frame section 34 and/or the sheet material 12 may further allow contraction/expansion of the sheet material 12.

Also, although both outer frame sections are shown to include a lip, alternative arrangements may only include a lip on one of the outer frame sections.

From the foregoing embodiments of FIGS. 4*b* and 4*c*, the skilled reader will understand that any combination of the methods and/or arrangements for restricting the vertical movement of the inner frame section 34 may be employed as necessary. For example, when lips are provided on the outer frame sections, it may not be necessary to provide the abutting faces of the inner frame sections and external frame with roughened surfaces, adhesive-based connections, or tongue and groove arrangements. Further, the above methodologies for restricting vertical movement of the inner frame section 34 may also be employed in an assembly which includes an inner frame section of another cross-sectional shape (i.e. those illustrated in FIGS. 3*a*-3*g*).

In other words, the means by which the first and second outer frames section can be connected together, with an inner frame section therebetween, can be selected from: locking geometries of the inner frame sections and the outer frames; frictional contact; bonding/adhesives; and compression clamping.

Referring to FIGS. 5*a*, 5*b* and 6, inner frame sections 50, 55 and 60 according to alternative embodiments of the invention each comprise a plurality of recesses.

The inner frame section 50 of FIG. 5*a* is an elongate extruded member and is formed with first 51 and second 52 parallel recesses for receiving sheet material 12*a* and 12*b*, wherein the cross-sectional shape of the first 51 and second 52 parallel recesses is substantially triangular. The sheet material 12*a* and 12*b* may, or may not, be formed from the same material.

Integral with and parallel to the longitudinal axis of the inner frame section 50 and the first 51 and second 52 recesses is a chamber 54 for desiccant material where required. An upper surface of the chamber 54 has a series of perforations 56 along its longitudinal length to permit air communication. Of course, other means for permitting air communication with the chamber 54 may be used. For example, at least one slit may be provided along the longitudinal length of the chamber 54.

A modification to the inner frame section of FIG. 5*a* is shown in FIG. 5*b*. The modified inner frame section 55 is formed with first 57 and second 58 parallel recesses for receiving sheet material 12*a* and 12*b*, wherein the cross-sectional shape of the first 57 and second 58 parallel recesses is substantially U-shaped. As before, integral with and parallel to the longitudinal axis of the inner frame section 55 and the first 57 and second 58 recesses there is provided a chamber 54 for desiccant material. Furthermore, a series of perforations 56 along the longitudinal length of the upper surface of the chamber 54 permit air communication.

As illustrated in FIG. 6, an inner frame section according to the invention may be formed with more than two recesses for receiving sheet material. The inner frame section 60 of FIG. 6 is an extruded member elongate in a longitudinal direction and is formed with first 61, second 62 and third 63 parallel recesses for receiving sheet material 12*a*, 12*b* and 12*c*.

Similarly to the embodiments of FIGS. 5*a* and 5*b*, the inner frame section is formed with a perforated chamber between each recess. Thus, parallel to the longitudinal axis of the inner frame section 60 and the first 61, second 62 and third 63 recesses are first 64*a* and second 64*b* chambers for desiccant material where required. Again, each chamber has a series of perforations 66 along its longitudinal length to permit air communication.

An embodiment of the invention therefore provides an inner frame section comprising a plurality of recesses for receiving sheet material, wherein between each recess there is provided moisture absorbing means. Such moisture absorbing means may be provided in a perforated chamber, or aerated channel, formed in the inner frame section.

Referring now to FIG. 7*a*, an alternative embodiment is illustrated. In this embodiment, an elongate extruded intermediate frame section 70 is formed for receiving first 10*a* and second 10*b* inner frame sections, the inner frame sections 10*a* and 10*b* being similar to the inner frame section 10 of FIG. 2.

The intermediate frame section 70 is formed with first and second parallel recesses or seats along its longitudinal length. Each recess defines a space whose shape corresponds to that of a portion of the outer cross-sectional shape of the inner frame sections 10*a* and 10*b*. In the embodiment of FIG. 7, each recess is formed to define a space whose shape corresponds to the outer cross-sectional shape of the inner frame sections 10*a* and 10*b*. In this way, the intermediate frame section 70 covers the base and one side of the neck portion of each inner frame section, leaving other side of the neck portion of each inner frame section exposed. Thus, it will be appreciated that the embodiment of FIG. 7*a* provides for the combination of inner frame sections 10*a* and 10*b*, each having a single recess, to form an inner frame assembly which can be arranged with first and second outer frame sections in a similar fashion to that illustrated in FIG. 4*a* In this way, there is provided a way of upgrading an existing single-panelled frame assembly to a double-panelled frame assembly without discarding of the existing single panel and/or the existing outer frame sections. The frame assembly may, therefore, further comprise a spacer element to increase the space between the first and second outer frames so that different sizes of inner frame sections can be fitted.

Furthermore, the intermediate frame section 70 is formed with a chamber 74 between the grooves. The chamber 74 has a series of perforations 76 along its longitudinal length to permit air communication. Thus, parallel to the longitudinal axis of the intermediate frame section 70 and the grooves there is provided an aerated chamber 74 for desiccant material where required. Provision of such a chamber 74 is, however, purely optional and should not be understood as essential to the invention.

Of course, an intermediate frame section according to the invention is not limited to catering only for inner frame sections having a triangular cross-sectional shape. As illustrated in FIG. 7*b*, an elongate extruded intermediate frame section 78 may be formed to receive first 36*a* and second 36*b* inner frame sections, wherein the inner frame section 36*a* and 36*b* have a generally U-shaped cross-sectional shape (similar to that illustrated in FIG. 3*h*). The intermediate frame section 78 is formed with first and second parallel seats along its longitudinal length, such that first 36*a* and second 36*b* inner frame sections may be supported side by side by the intermediate frame section 78.

Again, the intermediate frame section 78 is optionally formed with a chamber 74 between the parallel seats, wherein the chamber 74 comprises a series of perforations 76 along its longitudinal length to permit air communication.

The concept illustrated in FIGS. 7*a* and 7*b* can also be extended to cater for more than two inner frame sections without difficulty. For example, a third recess or seat may be formed in the intermediate frame section between the first and second recesses. Furthermore, to maintain the same outer cross-sectional shape of the inner intermediate frame section of that shown in FIG. 7*a* or 7*b*, the third recess/seat may be formed to define a space whose shape corresponds to the outer cross-sectional shape of an inner frame section that the third recess is required to receive.

It will be understood that an embodiment of the invention provides an inner frame portion comprising a plurality of recesses for receiving sheet material, wherein between each recess there is provided moisture absorbing means. Such moisture absorbing means may be provided in a perforated chamber, or aerated channel, formed in an inner frame section or in an intermediate frame section.

Referring to FIGS. 8*a*-8*e* a frame assembly according to the invention comprises the first and second elongate extruded outer frame sections, and may further comprise a spacer element to increase the gap between the first and second outer frame section.

In the embodiment of FIG. 8*a*, a first outer frame section 80 is arranged to receive sheet material 12 with an inner frame section 10 of FIG. 2 fitted thereon. The second outer frame section 85 is then arranged to be applied to the inner frame section 10 and the first outer frame section 80. The first 80 and second 85 external frame sections are then connected together using any such suitable connecting means in order to fix the external frame sections together with the inner frame section 10 therebetween.

The first external frame section 80 may be formed with an internal recess or internal channel 81 along its length, adapted to receive a metal reinforcing member 83 to increase strength. Although a specific example of the cross-sectional shape of the internal channel 81 and the reinforcing member 83 is illustrated in FIG. 8*a*, it should be understood that the internal channel and reinforcing member 83 may have any suitable cross-sectional shape. For example, and as illustrated in FIG. 8*b*, an alternative first external frame section 80*b* may be formed with a generally L-shaped internal channel 82 along its length. This internal channel 82 may then receive a generally L-shaped reinforcing member 84 made of a suitably strong material.

Of course, it is not essential to provide a reinforcing member 83 within the internal channel 81. Thus, the internal channel may be used for drainage purposes, providing a channel by which fluid can be removed.

The first 80 and second 85 outer frame sections may also be modified so that they each comprise a lip 87 which engages over the inner frame section 10, as illustrated in FIG. 8*c*. When the first 80*c* and second 85*c* external frame sections are connected together (using any such suitable connecting means) in order to capture the inner frame section 10 therebetween, the lip of each of the outer frame sections 80*c* and 85*c* is positioned above the inner frame section 10 to impede its vertical movement.

As detailed in the above description of the embodiment in FIG. 4*c*, modifications to the arrangement of the lip 87 will be obvious to the skilled reader. Accordingly, the illustration of FIG. 8*c* should not be taken as exact or limiting. For example, the lips 87 may be arranged such that the lips contact the inner frame section 10 in use. Further, alternative arrangements may only include a lip on one of the outer frame sections.

As illustrated in FIG. 9*a*, the first 80 and second 85 external frame sections may instead be connected together using a nut and bolt arrangement, the bolt(s) 90 and nut(s) 92 being fitted substantially perpendicular to the plane of the sheet material 12. In this way, the force holding the sections together may be increased or decreased as necessary, without exerting forces directly on the sheet material (which may be fragile, in the case of glass). Also, the first 80 and second 85 external frame sections can be screw fitted to a surround which is part of the structure in which the frame assembly is to be mounted, the screw(s) 94 being a locking screw or balancing screw fitted substantially parallel to the plane of the sheet material. It will, of course, be understood that the screws may be provided at other suitable angles.

Returning now to FIG. 8*a*, it will be appreciated that the outer frame sections retain the inner frame section in similar fashion to that of FIG. 4*a*. More specifically, the outer frame sections restrict movement of the inner frame section 10 in the lateral direction (the direction indicated generally by the arrow labelled 'X') since they are locked together in such a way that they are unable to move apart from each other. Also, by together defining a space whose shape corresponds to that of the outer cross-sectional shape of the inner frame section, the outer frame sections restrict movement of the inner frame section 10 in the vertical direction (the direction indicated generally by the arrow labelled 'Y') because the base portion of the inner frame section 10 is wider than its neck portion.

In other words, the outer frame sections cooperate to form a clamping unit to secure the inner frame section 10. This clamping unit clamps to the inner frame section 10 directly and does not contact the sheet material. Thus, the inner frame section 10 could secure the sheet material 12 in a barbed grip and/or press grip and/or silicon grip.

In FIG. 8*d*, the first outer frame section 80*d* is arranged to receive sheet material 12 with an inner frame section 50 of FIG. 5*a* fitted thereon. Similarly to above, the second outer frame section 85*d* is then arranged to be applied to the inner frame section 50 and the first outer frame section 80*d*, and the first 80*d* and second 85*d* external frame sections are connected together using suitable connecting means.

However, in this embodiment, because the inner frame section 50 comprises two recesses, the width of the inner frame section 50 is wider than that of the inner frame section 10 used in the embodiment of FIG. 8*a*. To accommodate for this increased width, a spacer 90 is positioned between the first 80*d* and second 85*d* frame sections and below the inner frame section 50. This spacer 90 has two purposes. Firstly, it increases the size of the gap between the first 80*d* and second 85*d* outer frame sections and, secondly, it supports the inner frame section 50 to prevent it from rotating out of a substantially horizontal rest position.

The invention, therefore, provides a frame assembly whereby different sizes of inner frame sections or inner frame portions (comprising an intermediate frame section and a plurality of inner frame sections, as in FIG. 7) can be fitted. Thus, the invention enables an earlier provided frame assembly to be modified to support fewer or more sheets of material, simply by disconnecting the outer frame sections and removing/inserting one or more sheets of material (with inner frame section(s) fitted thereon).

Is should be understood, from the illustration of FIG. 8*e*, that a frame assembly according to the invention is not limited to inner frame sections with a substantially triangular cross-sectional shape.

FIG. 8*e* demonstrates how the invention can be employed with an alternatively shaped inner frame section 88, wherein the inner frame section 88 has a base section with a substantially square cross-sectional shape and a neck portion that is less wide than the base portion. In the embodiment of FIG. 8*e*, the first 80*e* and second 85*e* outer frame sections each comprise a lip 87*e* which engages over the inner frame section 10. When the first 80*e* and second 85*e* external frame sections are connected together to capture the inner frame section 88 therebetween, the lip 87*e* of each of the outer frame sections 80*e* and 85*e* is positioned above the base portion of the inner frame section 88 to impede its vertical movement. Further, a gap may be provided between the lip and the inner frame section, and rubber beading can be included to allow compression/contraction of sheet material.

Of course, it will be appreciated that the concept of providing a lip on either, or both, of the outer frames sections can be extended to inner frame sections of any suitable shape. It is not limited to inner frame sections having a neck portion that is less wide than a base portion. For example, the outer frame sections may be arranged to receive an inner frame section having a U-shaped cross-sectional shape as shown in FIG. 3*h*. In such an arrangement, the lip(s) of the outer frame sections would be positioned above the U-shaped inner frame section to impede its vertical movement.

In FIG. 9*b*, a first outer frame section 95 is arranged to receive sheet material 12 with an inner frame section 55 of FIG. 5*b* fitted thereon. Similarly to above, a second outer frame section 97 is then arranged to be applied to the inner frame section 55 and the first outer frame section 95, and the first 95 and second 97 external frame sections are connected together using suitable connecting means. In the embodiment of FIG. 9*b*, the first 95 and second 97 external frame sections are connected together using a nut and bolt arrangement similar to that of FIG. 9*a*, the bolt(s) 90 and nut(s) 92 being fitted substantially perpendicular to the plane of the sheet material 12. Also, the first 95 and second 97 external frame sections are arranged to be screw fitted to a surround which is part of the structure in which the frame assembly is to be mounted, the screw(s) 94 being fitted substantially parallel to the plane of the sheet material 12.

Purely as an example of procedure, the second outer frame 97 may be secured to/in the structure in which the frame assembly is to be mounted, before the inner frame section 55 is applied to the second outer frame section 97. The first outer frame section 95 is then arranged to be applied to the inner frame section 55 and the second outer frame section 97, and the first 95 and second 97 outer frame sections are connected together to capture the inner frame section 55.

In a similar fashion to that illustrated in FIG. 8*b*, the first 95 and second 97 outer frame sections of FIG. 9*b* may be modified so that they each comprise a lip 98 which engages over the inner frame section 55 to impede its vertical movement. This modification is shown in FIG. 9*c*.

Yet another alternative arrangement is illustrated in FIG. 9*d*, wherein the outer frame sections 99*a* and 99*b* together define a space having a triangular or wedge-like cross-sectional shape, and wherein the inner frame section 36 has a U-shaped cross-sectional shape (as illustrated in FIG. 3*h*).

The triangular, or 'wedge-like', cross-sectional shape of the space defined by the first 99*a* and second 99*b* outer frame sections allows for variations in the size of the inner frame section 36, for example due to manufacturing tolerances. The outer frame sections 99*a* and 99*b* provide a clamping function, engaging with the inner frame section and pressing it towards the sheet material 12. In other words, because the width of the space defined by the outer frame sections decreases from bottom to top, differing sizes of inner frame sections 36 may be clamped between the outer frame sections.

This feature is advantageous in the field of manufacturing, within which it can be difficult and costly to make products with little to no variation in shape and/or size. In this regard, the provision of increased levels of tolerance whilst still enabling the performance of a function is highly desirable.

The first 99*a* and second 99*b* external frame sections are connected together using a nut and bolt arrangement, the bolt 90 and nut 92 being fitted substantially perpendicular to the plane of the sheet material 12. As explained in the description of FIG. 9*a*, the force holding the sections together may be increased or decreased as necessary, without exerting forces directly on the sheet material (which may be fragile).

The frictional grip of the resultant clamping arrangement may be enhanced by providing roughened or serrated surfaces on abutting faces of the inner frame section 36 and external frame sections 99*a* and 99*b*. Such serration could be fine or delicately indented/patterned. Further, the faces may have matching indentations.

FIG. 9*e* illustrates a modification of the first and second outer frame sections shown in FIG. 9*a*. This demonstrates how the provision of a spacer (i.e. spacer 90 in FIG. 8*d*) positioned between the first and second frame sections and below the inner frame section is not essential when arranging the frame assembly to cater for varying widths and/or sizes of inner frame sections. In FIG. 9*e*, the first outer frame section 80*e* is formed with a projection 86*e* extending in a generally horizontal direction towards the second outer frame 85*e*. The second outer frame 85*e* is formed with recess 89*e* for receiving the projection 86*e*, the recess 89*e* being positioned such that it receives the projection 86*e* when the first 80*e* and second 85*e* outer frame sections are connected together using a nut 92 and bolt 90 arrangement (the nut 92 and bolt 90 arrangement being positioned above the projection 86*e* and recess 89*e*).

By tightening or loosening the nut 92 and bolt 90 arrangement, the distance between the first 80*e* and second 85*e* outer frame sections can be reduced or increased, respectively. Furthermore, the projection 86*e* cooperates with the recess 89*e* to provide a support which hinders rotation of the second outer frame section 85*e* about the first outer frame section 80*e* out of a substantially horizontal rest position.

Use of the terms "projection" and "recess" is intended to portray that any suitable cooperating arrangement may be employed to provide the feature that a portion of an outer frame section extends into the other outer frame section when connected together.

For example, the projection 86*e* may be formed from a single lip that extends along a portion of the longitudinal length of the first outer frame section 80*e*. Accordingly, the recess 89*e* would be formed as a slot of at least corresponding length in the second outer frame section 85*e*. Alternatively, the projection 86*e* may be a pin, wherein the recess 89*e* is an appropriately sized hole.

Further, a series of projections may be formed on the first outer frame section 80*e*, wherein the projections 86*e* are spaced apart longitudinally and at regular or irregular interval along the longitudinal length of the outer frame section. A series of correspondingly spaced apart recesses 89*e* may then be provided in the second outer frame section 85*e*.

FIG. 9*f* illustrates another modification of the first and second outer frame sections shown in FIG. 9*a*. This modification is similar to that shown in FIG. 9*e*. However, in FIG. 9*f*, nut 92 and bolt 90 arrangement is positioned below the projection 86*f* and recess 89*f*, thereby demonstrating how modifications may be made to the arrangement without departing from general principle of the projection and recess arrangement.

It will also be apparent to the reader that it is not essential to form the first outer frame section with the projection. Instead, the second outer frame section may be formed with a projection extending towards the first outer frame section.

Accordingly, the first outer frame section would then be provided with a recess for receiving the projection of the second outer frame section.

Although preferable, provision of this cooperating projection and recess arrangement within the outer frame sections is not to be understood as essential since the nut 92 and bolt 90 arrangement may provide adequate support between the outer frame sections.

Referring to FIG. 10*a*, a corner piece 100 is designed to be fitted over the corner of a sheet of material 12. The corner piece 100 is formed with horizontal 101*a* and vertical 101*b* legs joined together at one end and a flange 102 extending outwardly from the distal end of each leg. The legs 101*a* and 101*b* of the corner piece are each formed with a recess extending along their longitudinal such that each leg has a cross-sectional shape corresponding to that of an inner frame section according to a previous embodiment of the invention. In other words, the legs 101*a* and 101*b* each have a neck portion 103 and a base portion 104, the neck portion 103 including a mouth of the recess, and the outer cross-sectional shape of each leg is such that their base portion 104 is wider than the neck portion 103.

Although the corner piece 100 is illustrated as being designed to fit over a right-angled corner of sheet material, it will be obvious to the reader that the design of the corner piece 100 may be readily modified to fit a corner/vertex of any angle, as may be required. For example, the angle formed between the legs of the corner piece would preferably be arranged to be the same as that defined by the corner of the sheet material to which the corner piece is to be fitted.

A modification of the corner piece 100 of FIG. 10*a* is shown in FIG. 10*b*. The modified corner piece 105 is designed to be fitted over the corner of a sheet of material 12. The corner piece 105 is formed with horizontal 106*a* and vertical 106*b* legs joined together at one end and a flange 107 extending outwardly from the distal end of each leg. The legs 106*a* and 106*b* of the corner piece are each formed with a recess extending along their longitudinal length such that each leg has a substantially U-shaped cross-sectional shape (corresponding to that of an inner frame section according to a previous embodiment of the invention). For example, the legs 106*a* and 106*b* may each have a U-shaped cross-sectional shape corresponding to the inner frame section 36 of FIG. 9*d*.

The corner pieces 100 and 105 of FIGS. 10*a* and 10*b*, respectively, are therefore designed to be fitted around the corner of the sheet material 12 and to cooperate with an inner frame section (having a substantially matching cross-sectional shape) that is also fitted to the sheet material 12. In this way, a seal may be formed between the inner frame section and the respective corner piece 100 or 105.

Although the above may suggest that a frame assembly can be constructed from section lengths fitted around the sides of a panel, with corner pieces completing the inner frame, this is not essential. In an alternative embodiment, the inner frame sections could extend around a corner so that the inner frame is in fact made up of four L-shaped corner pieces. If a corner piece extends along a significant length of the sheet material, then functionally it may be considered as an "inner frame section".

Referring now to FIG. 11*a*, the corner piece 110*a* is designed to fit over adjacent corners of two parallel sheets of material 12*a* and 12*b*. The legs of the corner piece are each formed with a recess for receiving the corner of the sheets 12*a* and 12*b* such that the sheets are arranged parallel to and spaced apart from each other with their edges in registration. When the corner piece 110*a* is fitted over the adjacent sheet corners, an area of each of the outer faces of the sheets is covered. Part of the periphery of each of the sheets is also covered by the corner piece when it is fitted over the adjacent corners.

Although not essential, the corner piece 110*a* also includes a valve 112 for the ingress or expulsion of gas between the parallel sheets 12*a* and 12*b*. In this way, there is provided a means by which argon, or another suitable gas, can be filled into a double or triple glazed assembly, for example. Further, it may enable gas to be removed to provide a partial or total vacuum. The valve can be a conventional gas/air non-return valve.

By fitting two such corner pieces, each comprising a valve 112 for the ingress or expulsion of gas, a frame assembly may be arranged wherein one corner piece is adapted to allow the ingress of gas and the other corner piece is adapted to allow the expulsion of gas. In this way, the gaseous environment between the generally parallel sheets may be modified as necessary.

The valve can be hermetically sealed in a bore drilled through the corner piece, which may be moulded as one piece or formed of two extruded and mitred pieces, hermetically bonded together.

It will be appreciated that, in an alternative version of the above embodiments, the legs may be formed with a plurality of parallel recesses, each recess for receiving the corner of a panel. Such an alternative embodiment is illustrated in FIG. 11*b*.

As with the corner piece 110*a* of FIG. 11*a*, the corner piece 110*b* of FIG. 11*b* is designed to fit over adjacent corners of two parallel sheets of material 12*a* and 12*b*. The legs of the corner piece are each formed with first 113*a* and second 113*b* parallel recesses, each recess for receiving a corner of the sheets 12*a* and 12*b*, respectively. In this way, the corner piece 110*b* receives the sheets 12*a* and 12*b* such that the sheets are arranged parallel to and spaced apart from each other with their edges in registration. The sections between each recess therefore act as spacing elements which ensure a correct gap is provided between the sheets 12*a* and 12*b*. Of course, from above, it will be appreciated that moisture absorbing means may also be provided between the recesses.

Again, the corner piece 110*b* preferably includes a valve 112 for the ingress or expulsion of gas between the sheets 12*a* and 12*b*.

For a better understanding, an example of an alternative embodiment is illustrated in FIG. 11*c*. FIG. 11*c* shows the distal end of a modified horizontal leg 106*a* and flange 107 of the corner piece 105 in FIG. 10*b*. Also shown in FIG. 11*c* is an inner frame section according to an embodiment of the invention.

The leg 106*a* of the corner piece and flange 107 is formed with a plurality of spaced apart recesses 114 extending in the longitudinal direction of the flange 107 and leg 106*a*. Each recess 114 is for receiving the edge of a sheet or panel. Thus, leg 106*a* of the corner piece can receive two sheets (not shown) such that the sheets are arranged parallel to and spaced apart from each other with their edges in registration. It is preferable to attach the corner piece to the sheets using an adhesive or clamp arrangement, as with earlier embodiments.

The flange 107 is also formed with grooves 115 in the opposing surface to within which the recesses 114 are formed. The grooves 115 are spaced apart and extend in the longitudinal direction of the flange 107 such that they are formed substantially parallel to and between the recesses 114. In the example shown, the recesses 114 and grooves 115 are formed to an approximately equal depth, thereby forming a generally corrugated tongue of substantially equal thickness throughout its alternating ridges and troughs. However, alternatively, the recesses 114 and grooves 115 may be formed of differing depths and spacing as necessary.

The inner frame section 116 is an elongate extruded member and formed with a first 117*a* to fourth 117*d* spaced apart and parallel recesses, wherein the second 117*b* and third 117*c* recesses are positioned between the first 117*a* and fourth 117*d* recesses. The cross-sectional shape of each recess is substantially U-shaped, although the width of the second 117*b* and third 117*c* recess is greater than that of the first 117*a* and fourth 117*d* recesses. In this way a plurality of tongues 118 is formed in the inner frame section 116, wherein the geometry of the tongues 118 also corresponds with the grooves 115 formed in the flange 107 of the leg 106*a*. Thus, the inner frame section 116 can cooperate with the corner piece such that the tongues 118 engage with the grooves 115, rather like rows of interlocking teeth. In other words, the corner piece and frame section 116 have overlapping mating parts. Further, the width of the second 117*b* and third 117*c* recess is such they are can each receive the edge of a sheet or panel in a similar fashion to that described in earlier embodiments (for example, as illustrated in FIG. 5*b*).

The corner piece can be fitted around the corner of the multiple panel structure and cooperate with an inner frame section that is also subsequently fitted to the multiple panel structure. A seal can therefore be formed between the inner frame section and the corner piece. The corner piece and adjoining inner frame section may be externally flush and continuous and the internal the walls of such an inner frame section are preferred thinner than the corner piece to compensate for the depth of the flange.

To demonstrate that the concept shown in FIG. 11*c* is not limited to corner piece and frame section having a generally U-shaped cross-sectional shape, FIG. 11*d* shows the distal end of a modified horizontal leg 101*a* and flange 102 of the corner piece 100 in FIG. 10*a*. It will be understood from the description of FIG. 10*a* that legs of the corner piece 100 each have a neck portion 103 and a base portion 104, and the outer cross-sectional shape of each leg is such that their base portion 104 is wider than the neck portion 103.

In a similar manner to that of the leg 106*a* shown in FIG. 11*c*, the leg 101*a* of the corner piece 100 and flange 102 is formed with a plurality of spaced apart recesses 114 extending in the longitudinal direction of the flange 102 and leg 101*a*. Each recess 114 is for receiving the edge of a sheet or panel. As with earlier embodiment, it may be preferable to attach the corner piece to the sheets using an adhesive or clamp arrangement, The flange 102 is also formed with grooves 115 in the opposing surface to within which the recesses 114 are formed. The grooves 115 are spaced apart and extend in the longitudinal direction of the flange 102 such that they are formed substantially parallel to and between the recesses 114. In the example shown, the recesses 114 and grooves 115 are formed to an approximately equal depth, thereby forming a generally corrugated tongue of substantially equal thickness throughout its alternating ridges and troughs. Of course, the recesses 114 and grooves 115 may alternatively be formed of differing depths and spacing as necessary.

The inner frame section 119 is an elongate extruded member having an outer cross-section that it substantially the same as that of the leg 101*a*. Also, the inner frame section 119 is formed with a first 117*a* to fourth 117*d* spaced apart and parallel recesses. In this way a plurality of tongues 118 is formed in the inner frame section 119, wherein the geometry of the tongues 118 also corresponds with the grooves 115 formed in the flange 102 of the leg 101*a*. Thus, the inner frame section 119 can cooperate with the corner piece such that the tongues 118 engage with the grooves 115. Further, the width of the second 117*b* and third 117*c* recess is such they are can each receive the edge of a sheet or panel in a similar fashion to that described in earlier embodiments (for example, as illustrated in FIG. 5*b*).

The skilled reader will appreciate that the modifications may be made to geometry of the recesses and grooves formed in the flange and inner frame section, whilst still enabling the corner piece and inner frame section to receive sheets of material. To demonstrate this, FIG. 11*e* shows a modification of the corner piece and frame section illustrated in FIG. 11*c*.

The leg 106*a* in FIG. 11*e* is similar the that in FIG. 11*c*, however, the middle groove 115*e* formed in the flange 107 is formed to have a wedge-like shape, wherein the width of the groove 115*e* increases as the depth of the groove 115*e* increases. Also, the middle tongue 118*e* formed in the inner frame section 116 has a wedge-like shape such that its width increases with the distance it protrudes from the base of the inner frame section. In this way, the cross sectional shape of the middle groove 115*e* formed in the flange is designed to correspond with the cross-sectional shape of the middle tongue 118*e* provided in the inner frame section 116.

As with the previous embodiments of FIGS. 11*c* and 11*d*, the inner frame section 116 can cooperate with the leg 106*a* of the corner piece such that the tongues 118 and 118*e* engage with the grooves 115 and 115*e*. However, in the embodiment of the FIG. 11*e*, the inner frame section 116 must be slid onto the flange 107 of the leg 106*a* in generally longitudinal direction of the frame section 118*e* and the leg 106*a* (as illustrated by the arrows labelled "L"). The wedge-like, or triangular, cross-sectional shapes of the middle tongue 118*e* and groove 115*e* arrangement thus cooperate to restrict movement in the vertical direction with respect to each other.

Further to the illustration of FIG. 11*e*, it should be appreciated that the any number of the tongues 118 of the inner frame section 116 and corresponding recesses 115 in the flange 107 may be formed to have cooperating wedge-like or triangular cross-sectional shapes as described above.

Accordingly, there is provided a method of constructing a framed multiple panel structure, for example a framed window, wherein a corner piece for covering a corner of the multiple panel structure is fitted on each corner thereof. The corner piece therefore spaces the panels of the structure correctly as may be required. Inner frame sections may then be fitted on the edges of the panel structure, the inner frame sections also having at least one recess for receiving the multiple panel structure. By arranging the corner pieces and frame sections such that they have overlapping mating parts a seal in the area of the overlap may be formed easily.

When there are plural panels, the corner pieces may be adapted to hold the panels in a substantially parallel relationship, before fitting of the frame sections. Further, to assist in the correct positioning of the panels, a mounting insert can be provided in the corner pieces and/or the frame sections To secure the multiple panel structure within the recesses, a sealing or bonding material, for example a silicone sealant, is preferably provided in recesses. Alternatively, a clamping arrangement may be employed for the same purpose.

Alternative embodiments of a corner piece are illustrated in FIG. 12*a* or 12*b*. FIG. 12*a* illustrates an L-shaped corner piece 120 with a horizontal and vertical leg and formed with an extension at its apex, the extension 122 extending away from the sheet material fitted into the corner piece 120. Consequently, the extension 122 is arranged to extend into a surround which is part of the structure in which the frame assembly is to be mounted. FIG. 12*b* illustrates an L-shaped corner piece 124 formed with a reinforcement section 126 extending over the corners of the sheet material fitted into the corner piece 124. Both of these embodiments provide greater strength to the corners of the sheet material fitted therein.

Illustrated in FIG. 13 is a cross-sectional view of an inner frame section according to yet another embodiment of the invention. The inner frame section 10 is similar to that as shown in FIGS. 1 and 2 in that it is an elongate extruded member having a recess 11 for receiving sheet material 12. The inner frame section 10 can be fitted around the periphery of the sheet material.

However, in this embodiment, a mounting insert 130 having a recess 131 is arranged within the recess 11 of the inner frame section 10 to assist the correct location of the sheet material 12 in the recess.

The mounting insert has a neck portion 132 and a base portion 133, the neck portion 132 including a mouth 134 of the mounting insert's recess 131. Also, the outer cross-sectional shape of the mounting insert 130 substantially corresponds to the inner cross-sectional shape of the inner frame section 10. In the illustrated embodiment, the mounting insert is formed from aluminium and has a thickness of between 2-5 mm. Of course, as with the other components of the frame assembly, the mounting insert 130 may be of greater, lesser or varying thickness and made of other materials, such as steel, UPVC or a plastics or polymer material.

The mounting insert 130 is also formed with substantially parallel and spaced apart first to third ribs or tongues 136*a*, 136*b* and 136*c* protruding from its base portion 133 into the recess of the mounting insert 130 (the second tongue 136*b* being positioned between the first 136*a* and third 136*c* tongues). The first 136*a* and third 136*c* tongues protrude into the recess 131 further than the second tongue 136*b* and are laterally spaced by a distance substantially corresponding to the thickness of the sheet material 12.

In this way, when the sheet material 12 is inserted into the recess 11 through the mouth 18, the sheet material 12 is received in the recess 131 of the mounting insert 130 through its mouth 134 and supported by the tongues 136*a*, 136*b* and 136*c*. Thus, the first 136*a* to third 136*c* tongues engage with the periphery of the sheet material 12 to support and position the sheet material 12, wherein the mounting insert is fitted around the periphery of the sheet material. The first 136*a* to third 136*c* engage with opposing faces of the sheet material to locate the sheet material 12 laterally, whereas second tongue 136*b* engages the edge surface of the sheet material 12 to position it vertically. As before, sealing and/or bonding material is the provided in the recess 11 to fill any remaining space.

Accordingly, the sheet material 12 can be positioned within the recess 11 and supported by the mounting insert 130 such that a desired spacing is attained between the sheet material 12 and the inner surface of the inner frame section 10. Modification of the size/thickness or the mounting insert 130 and its supporting tongues 136*a* to 136*c* may then be used to define the position of sheet material 12 relative to the inner frame section 10 as required.

It will be appreciated that the concept of including a mounting insert within the recess of an inner frame section can be extended to a corner piece. In other words, a mounting insert may be provided in a recess of a corner piece according to an embodiment of the invention, thereby assisting the correct location of sheet material in the recess of the corner piece. Such a corner piece, with a mounting insert provided therein, is illustrated in FIG. 14.

In FIG. 14 a corner piece 140 (similar to that shown in FIG. 10*a*) is fitted onto a corner of sheet material 12. Provided in the recess of each leg 142*a* and 142*b* of the corner piece 140 (in a similar fashion to that shown in FIG. 13) is a mounting insert 145.

The mounting insert 145 has a similar cross-sectional shape to the mounting insert 132 shown in FIG. 13 and has an outer cross-sectional shape that substantially corresponds to the inner cross-sectional shape of each recess. Also, the mounting insert extends along the length of the recess provided in each leg 142*a* and 142*b*

The mounting insert 145 is also formed with substantially parallel ribs or tongues 147 that are spaced apart along the longitudinal length of each leg. The ribs or tongues protrude from the base portion 149 of the insert 145 away from the respective legs 142*a* and 142*b* and towards the sheet material 12. When the sheet material 12 is inserted into the recess of each leg 142*a* and 142*b*, the sheet material 12 is received by the mounting insert 145 and supported by the ribs or tongues 147. Thus, the mounting insert 145 engages with the periphery of the sheet material 12 to support and position the sheet material 12. Further, sealing and/or bonding material may be provided in any gaps between the sheet material, the mounting insert 145 and/or the recess of each leg.

Accordingly, the sheet material 12 can be positioned within the corner piece 140 and supported by the mounting insert 145 such that a desired spacing is attained between the sheet material 12 and the inner surface of the corner piece 140. Modification of the size/thickness or the mounting insert 140 and its supporting tongues 147 may then be used to define the position of sheet material 12 relative to the corner piece as required.

As will be understood from FIGS. 11*a* and 11*b*, the corner piece 140 shown in FIG. 14 may alternatively be formed with more than one recess in each leg, each recess being adapted to receive a corner of a respective sheet. Thus, a spacing element may then be provided in each recess in a similar manner to that shown in FIG. 14.

The described outer frames can of course be constructed from multiple frame lengths, so for example a four-sided inner or outer frame is made of four frame lengths, in a fashion which is well-known in the art (though of course the features of the frames described above are not conventional). The putting together of the frame lengths may be done in situ, for example at the window opening, or at the manufacturing site.

It will, of course, be appreciated by those skilled in the art that changes may be made to the embodiments described without departing from the principles and scope of the invention.

For example, the inside dimensions and/or cross-sectional shape of the inner frame section need not correspond to that of the outside dimensions and/or cross-sectional shape of the inner-frame section. Exemplary inner-frame sections illustrating this principle are shown in FIGS. 15*a* and 15*b*.

The inner-frame section 150*a* of FIG. 15*a* is similar to that as shown in FIGS. 1 and 2 in that it is an elongate extruded member having a recess 152 for receiving sheet material 12. However, the recess 152 has a generally U-shaped cross-sectional shape, whereas the outer cross-sectional shape of the inner-frame section 150*a* is triangular. Furthermore, the recess 152 is a separate packing component inserted within the inner-frame section 150*a*. Between the recess 152 and the outer body of the inner-frame section 150*a*, there is provided packing material 154 to support and/or restrict movement of the recess 152. Of course, recess 152 and the packing material 154 may be the same material.

Similarly, the inner-frame section 150*b* of FIG. 15*b* also has recess having a generally U-shaped cross-sectional shape, whereas the outer cross-sectional shape of the inner-frame section 150*b* is triangular. However, inner-frame section 150*b* of FIG. 15*b* differs from that of FIG. 15*a* in that the sides and/or bottom of the U-shaped recess is connected to base portion of the inner-frame section 150*b* for extra strength.

The embodiments of FIGS. 15*a* and 15*b* demonstrate how the depth by which the sheet material must be inserted into the recess and bonded need only be sufficient to bond the sheet material 12 to the inside of the inner-frame section. Thus, the inside of the inner-frame section may be packed out with other material or bulkheads for the purpose of strengthening, whilst the bonding area/volume need only be deep enough to contain the sheet material 12 and bonding agent 20. For example, the recess in the inner-frame section could be a simple oblong shape slightly bigger than the sheet material 12 being bonded to it. Preferably, the bonding area/volume is firmly attached to the inner-frame section.

It will also be appreciated that the shape of the inner-frame section need not be symmetrical (i.e. a mirror image front and back). As shown in FIGS. 16*a* and 16*b*, one side of the inner-frame section may be longer and/or deeper so as to further prevent the unit from being levered through the outer frame from the outside. Such a design may also help to prevent the attack of implements like an angle grinder, where one side of the inner-frame section is at lower position and hidden from an external framework.

Referring to FIG. 17, the inner-frame section may alternatively be a double capping on an inner-frame section or corner piece. Such a design enables the sheet material 12 to be attached to the inside of the inner-frame section 170 (having holes 172 for bonding agent ingress) and then have a further sealed surface 174 capped over it to increase its integrity. This two-part design can provide additional air drying time for the bonding agent to cure.

Further, as illustrated in FIG. 18, the inner frame section 180 may be formed with an additional recess or expansion chamber 182 between the recesses 184 and 186 that are provided for receiving sheets of material 12. The additional recess 182 is provided so as to enable a further sheet of differing material 188 (such as Polycarbonate) to be added inside the centre of the sealed assembly, i.e. as a third layer. The chamber 182 may preferably be of a different width and/or depth to accommodate a sheet having a differing expansion rate to the material secured in the other recesses 184 and 186 of the inner frame section 180. Of course, the chamber 182 need not be between the other recesses 184 and 186 such that, in alternative embodiments, the chamber 182 may be provide on one side of the inner frame 180 (i.e. the front and/or the back).

Because the further sheet of material 188 may expand at a different rate to the other sheets of material 12, it may be only loosely fitted inside the additional recess 182 of inner-frame section 180 (preferably, in a relatively deep channel or groove to give it strength).

As shown in FIG. 18, the sheet material secured in the additional recess 182 may be positioned and bonded so that at least one gap 190 is provided between the sheet of material 188 and additional recess 182, thereby accommodating expansion of the sheet material 188.

An inner frame section according to the invention may therefore have one or more recesses, so that the inner frame section may receive one or more sheets of material. Such sheets may be of the same or differing material and may or may not be fixedly attached to the inner frame section.

It should also be understood that the cross sectional shape of the inner-frame section 10 may be of any suitable shape, as further illustrated in FIG. 19*a* to 19*c*. From FIG. 19*a* in particular, it will be appreciated that the shape of the inner-frame section can be varied along its longitudinal length. Further, from FIGS. 19*b* and 19*c*, it will be appreciated that the shape of the inner-frame section need not be symmetrical about the sheet material inserted therein (i.e. a mirror image front and back). These variations in shape may be replicated in part or in whole of the adjoining outer-frame section(s) so as to provide a self-locating and/or self-locking fit between the inner and outer frame sections (i.e. the inner and outer frame sections are complimentary in geometry whole or in part).

For the avoidance of any doubt, the frame assembly of FIG. 20 illustrates how the first and outer second outer frames need not together define a space having the same shape as the inner frame section. Instead, the first 200 and second 205 outer frame sections may together define a space simply for receiving and capturing an inner frame section. Thus, referring to FIG. 20, the outer frame sections 200 and 205 each comprise a lip 210 which contacts the side of the inner frame section 50 to secure it in position. When the first 200 and second 205 outer frame sections are connected together to capture the inner frame section 50 therebetween, the lip 210 of each of the outer frame sections 200 and 205 engage the inner frame section 50 to impede its movement. In other words, the outer frame sections 200 and 205 cooperate to form a clamping unit to secure the inner frame section 50.

The invention claimed is:

1. A frame assembly for sheet material, comprising:

an inner frame section having at least one recess for receiving the sheet material therein, wherein the at least one recess of the inner frame section is fittable around the peripheral edge of the sheet material;

a first outer frame for receiving the sheet material with the inner frame section fitted thereon;

a second outer frame for receiving the sheet material with the inner frame sect fitted thereon; and means to connect the first and second outer frames together;

wherein the first and second outer frames together define a space for receiving the inner frame section, wherein the first and second outer frames are adapted to apply a compressive force to the inner frame section to clamp the inner frame section and substantially prevent movement of the inner frame section relative to the first and second outer frames, and wherein a geometry of the inner frame section is such that the inner frame section has a neck portion and a base portion, the neck portion including a mouth of the at least one recess, wherein the outer cross-sectional shape of the inner frame section is such that the base portion is wider than the neck portion.

2. A frame assembly according to claim 1, wherein the cross-sectional shape of the inner frame section is substantially triangular.

3. A frame assembly according claim 1, wherein the cross-sectional shape of the base portion of the inner frame section is selected from circular, regular polygonal and irregular polygonal.

4. A frame assembly according to claim 1, wherein a mounting insert is arranged within each recess of the inner frame section, for assisting the correct location of the sheet material in the recess.

5. A frame assembly according to claim 1, further comprising a spacer element to increase the space between the first and second outer frame or to increase the length of the outer frames, whereby different sizes of the inner frame section can be fitted subsequently.

6. A frame assembly according to claim 1, wherein the first and second outer frames are provided with at least one respective projection and groove, so that their distance apart can be adjusted.

7. A frame assembly according to claim 1, comprising tightening means for tightening and fitting the second outer frame to the first outer frame.

8. A frame assembly according to claim 1, comprising bolts for bolting the first outer frame to a surround which is part of the structure in which the frame assembly is to be mounted, the bolts being fitted transversely of the sheet material.

9. A frame assembly according to claim 1, wherein the cross-sectional shape of the space between an inner frame and the outer frames corresponds to that of the inner frame section.

10. A frame assembly according to claim 1, wherein a sealing and/or bonding material is provided in the recesses of the inner frame section.

11. A frame assembly according to claim 1, wherein the frame assembly is a window or door frame assembly and the sheet material is glass, clear, opaque, or translucent.

12. A frame assembly according to claim 1, wherein the inner frame section and the outer frames are made of aluminium, steel, UPVC or other plastics or polymer material.

13. Amended) A frame assembly according to claim 1, wherein at least one of the first and second outer frames include a lip which in use engages over the inner frame section.

14. A frame assembly according to claim 1, wherein the sides of the inner frame section are flexible, so that on holding of the inner frame section between the outer frames, the sides of the inner frame section can be compressed towards the sheet material.

* * * * *

UNITED STATES PATENT AND TRADEMARK OFFICE

CERTIFICATE OF CORRECTION

PATENT NO. : 8,752,354 B2
APPLICATION NO. : 12/390347
DATED : June 17, 2014
INVENTOR(S) : Honey It is certified that error appears in the above-identified patent and that said Letters Patent is hereby corrected as shown below:

In the claims

Column 24, Claim 1, line 36, delete "sect" and insert --section--.

Column 26, Claim 13, line 7, delete "Amended)".

Signed and Sealed this
Twentieth Day of October, 2015

Michelle K. Lee

Michelle K. Lee
*Director of the United States Patent and Trademark Office*